US010059014B2

(12) United States Patent
Scheid et al.

(10) Patent No.: US 10,059,014 B2
(45) Date of Patent: Aug. 28, 2018

(54) DEVICE FOR CARRYING OUT CUTTING OPERATIONS OF UNBOUND FORMATTING EDGES OF A PRINTED PRODUCT

(71) Applicant: Mueller Martini Holding AG, Hergiswil (CH)

(72) Inventors: Peter Scheid, Schafisheim (CH); Christoph Berger, Brugg (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/788,818

(22) Filed: Oct. 20, 2017

(65) Prior Publication Data

US 2018/0056537 A1 Mar. 1, 2018

Related U.S. Application Data

(63) Continuation of application No. PCT/CH2016/000053, filed on Mar. 29, 2016.

(30) Foreign Application Priority Data

Apr. 21, 2015 (CH) ..... 549/15

(51) Int. Cl.
*B26D 1/09* (2006.01)
*B26D 7/06* (2006.01)
(Continued)

(52) U.S. Cl.
CPC ..... *B26D 1/09* (2013.01); *B26D 7/025* (2013.01); *B26D 7/0633* (2013.01);
(Continued)

(58) Field of Classification Search
CPC ..... B26D 1/09; B26D 7/0633; B26D 7/025; B26D 11/00; B26D 7/0675; B26D 2007/0056; B26D 2007/0081
See application file for complete search history.

(56) References Cited

U.S. PATENT DOCUMENTS 9,808,949 B2 * 11/2017 Hori ..... B26D 5/08
2001/0023630 A1 * 9/2001 Nakajima ..... B26D 1/09 83/454

(Continued)

FOREIGN PATENT DOCUMENTS

CH 456533 A 7/1968
DE 19515705 C1 10/1996

(Continued)

*Primary Examiner* — Sean Michalski
(74) *Attorney, Agent, or Firm* — Leydig, Voit & Mayer, Ltd.

(57) ABSTRACT

A device for carrying out cutting operations on an unbound formatting edge of a printed product includes a cutter to carry out edge-related cutting operations. A transporter transports the printed product from a first cutting location, at which the first cutting operation for a first formatting edge of the printed product takes place, to a second cutting location, at which a second one of the cutting operations for a second formatting edge takes place, and to a third cutting location, at which a third one of the cutting operations for a third formatting edge is carried out. The transport of the printed product from one cutting location to the next is carried out along a guide section. The transporter includes a gripper with which the printed product is gripped by the spine and conveyable from one cutting location to the next in a suspended manner.

35 Claims, 11 Drawing Sheets

(51) Int. Cl.
*B26D 11/00* (2006.01)
*B26D 7/02* (2006.01)
*B26D 7/00* (2006.01)

(52) U.S. Cl.
CPC ..... *B26D 7/0675* (2013.01); *B26D 11/00* (2013.01); *B26D 2007/0056* (2013.01); *B26D 2007/0081* (2013.01)

(56) References Cited

U.S. PATENT DOCUMENTS

2003/0041712 A1 3/2003 Tsuruta
2004/0227282 A1* 11/2004 Grewe ..... B26D 7/0675 271/218
2005/0061133 A1 3/2005 Marbacher
2005/0179189 A1* 8/2005 Boss ..... B26D 7/0675 270/52.17
2006/0081100 A1 4/2006 Fassbind
2006/0123969 A1* 6/2006 Fujita ..... B26D 7/025 83/697
2007/0267801 A1* 11/2007 Wakabayashi ..... B26D 1/08 270/52.17
2009/0208268 A1* 8/2009 Silberbauer ..... B26D 1/08 400/76
2010/0018368 A1* 1/2010 Meyer ..... B26D 7/025 83/13
2010/0278617 A1* 11/2010 Sano ..... B26D 1/08 412/16
2011/0044786 A1* 2/2011 Marsh ..... B26D 1/08 412/1
2011/0049781 A1* 3/2011 Lewalski ..... B26D 7/015 270/58.07
2017/0361484 A1* 12/2017 Pardini ..... B26D 7/02

FOREIGN PATENT DOCUMENTS

DE 102011105253 A1 12/2012
EP 1504860 A1 2/2005
EP 1647373 A1 4/2006
JP 2012218114 A 11/2012

* cited by examiner

DEVICE FOR CARRYING OUT CUTTING OPERATIONS OF UNBOUND FORMATTING EDGES OF A PRINTED PRODUCT

CROSS-REFERENCE TO PRIOR APPLICATIONS

This application is a continuation of International Patent Application No. PCT/CH2016/000053, filed on Mar. 29, 2016, which claims priority to Swiss Patent Application No. CH 00549/15, filed on Apr. 21, 2015. The entire disclosure of both applications is hereby incorporated by reference herein.

FIELD

The present invention relates to a device for carrying out cutting operations on unbound formatting edges of at least one printed product, namely to cut at least one head, front, and tail edge, as disclosed for example in EP1504860 A1.

The term "unbound formatting edges" is thus taken to mean the head, front and tail portions of the printed product, regardless of whether these are composed of individual pages or signatures.

For the industrial production of printed products, preferably book blocks or brochures, in a small or very small run, what is known as a three-knife trimmer is used for operation, which is capable of cutting products with the same or variable formats and thicknesses consecutively to the desired formats with a high clock cycle output and the highest cut quality.

The book blocks or brochures are cut to the end format at three cutting stations at a predetermined thickness at the head, tail and front sides. The book blocks or brochures are bound on the spine side. All known methods are possible for binding, such as, for example; thread stitching, adhesive binding, saddle stitching, etc.

The three-knife trimmer can be used both as a solo machine and as a machine in a line network with other manufacturing machines.

BACKGROUND

The object of the invention, called a three-knife trimmer below, consists in cutting the printed products provided, in other words generally book blocks and/or brochures, at the three unbound sides. This takes place in that the book block or the brochure (only called a book block below) is clamped while stationary between pressing strips or pressing plates and the three above-mentioned sides of the book block are cut by means of three cutting devices. The cutting devices can be configured as counter-blade units, in which two blades cut against one another in the manner of scissors or as blade units having cutting strips, in which one blade cuts against a rigid plastics material strip, whereby for protection the knife edge easily penetrates into the plastics material strip in the end position.

In three-knife trimmers of this type, the head and tail are generally cut in a first phase and the front is cut in a second phase. However, the order is not imperative and it may also be carried out in reverse. It is furthermore possible to carry out only the head and tail cut or only the front cut on the book block, which, for example, is required for the production of English brochures.

There are three-knife trimmer configurations in which the book block remains stationary between the first cutting phase (for example head and tail cut) and the second cutting phase (for example front cut), and there are configurations in which the book block is transported between the cutting phases.

Three-knife trimmers have also become known in which the book blocks are pressed for cutting between pressing punches and cutting cassettes and are rigidly held for the cutting operation(s). When the pressing punch is raised, the cut book block is transported out and the next book block to be cut is introduced. The book block is brought into its position by a centering device and is then clamped by the pressing punch that is moving down. The blades move against the book with a swing cut and cut the unbound sides. After all the sides have been cut, the pressing punch is raised and the next work cycle can begin. This three-knife configuration is not, however, suitable for a rapid format changeover. The pressing punch and also the cutting cassette are customized for the format to be processed and can thus only be exchanged by stopping the machine.

A three-knife trimmer is disclosed in DE 102011105253 A1, in which the blades cut against cutting strips or counter-blades, wherein the book block is held by pressing strips next to the blades during a head and tail cut and during the front cut. A plurality of zigzag-shaped support webs for supporting the book block during cutting is arranged in the free space, which can be varied depending on the format, between the cutting strips or counter-blades, on the one hand, and the space between the pressing strips, on the other hand. Using a three-knife trimmer of this type, a good cut quality can be achieved because the book block is pressed or supported by the pressing strips and the zigzag-shaped support webs during cutting.

However, it has to be borne in mind with this solution that the book block can catch on the zigzag-shaped support webs during transport in and out of the cutting position. This circumstance is counteracted in DE 102011105253 A1, in that the transport system consists of a lower belt and an upper belt, the two belts for transporting the book block being moved together slightly with respect to one another so the book block cannot catch on the support webs of the cutting table plane or the pressing plane. However, with book block transportation of this type, the result is that with different book block thicknesses only one book block can ever be transported in the transport system. This restricts the permissible thickness difference from book block to book block because a plurality of book blocks is located in the transport system. In particular, with three-knife trimmers, in which the cut takes place at two stations, the transporting of book blocks that vary considerably with respect to thickness becomes a problem in the described transport system. With book block thicknesses which vary considerably, it is therefore necessary always to transport only one book block within the transport system. However, with a three-knife trimmer of this type, this restricts the capacity, i.e. the three-knife trimmer can only be operated at a low clock cycle (output).

Further three-knife trimmers, which define the prior art, are described in DE 102011105253 A1. However, none of them can satisfy the requirements for a quick changeover time linked with the requirement for a high cut quality.

A three-knife trimmer is disclosed in EP 1504860 A1, in which the book blocks to be cut are gripped by a positioning device and fed by an advancing device to the cutting devices. A plurality of cutting devices arranged at a distance from one another are provided, in which the book blocks are consecutively positioned in each case for a side cut by the advancing device. A side cut is carried out on the positioned printed product in each cutting device. The aligned book blocks are moved into a transfer position by the positioning device using an infeed gripper by means of a linear lifting movement, the alignment of the book blocks not being changed. The advancing of the book blocks takes place with a multiple planetary gear. Adjustable connecting control links are provided to position the book blocks in the cutting devices. The device allows an easy and rapid changeover to other formats. Each cutting device consists of a lower blade fixed to the frame and an upper blade, to which a pressing plate is coupled by means of a guide and a pneumatic cylinder. The pressing plate clamps the book block before cutting between the pressing plate and the stationary lower blade. In this case, the book block is not pressed over a large area, but only in the cutting region by the pressing plate and the lower blade, as well as the advancing device. The regions of the book block which are not pressed tend to "sag" and may therefore result in an unsatisfactory cut quality. This is particularly the case the book blocks consist of soft and/or thin paper.

A three-knife trimmer is described in JP2012-218114 A, which can process different book formats in succession and in which the outer sides of the book are not damaged. A clamping unit to grip the spine side of the printed product is attached to a moving part, the clamping unit having a reference face for positioning the spine of the printed product. Using a positioning actuator, the moving part is moved in a vertical plane by a controller and is positioned, in each case correctly for the format, for the cutting processes on the three unbound sides of the printed product, so that the cutting blades, which are moving in the horizontal direction, can cut the printed product. The printed product is aligned with the reference face of the clamping unit and a vertical contact face, as a result of which the controller is able along with the format data to approach the positions required for the respective cut and to correctly position the printed product for the cut.

The inventors have recognized that a drawback with this last mentioned three-knife trimmer is the limited possibility of varying the book format. Since the one clamping unit holds the printed product for all three cuts, the clamping unit has to be made substantially smaller than the smallest printed product to be processed. If the printed product has a substantially larger format, the plates, which are additionally used to support the printed product during cutting, have to be provided with a large hollowed-out region. A large hollowed-out region has a disadvantageous effect, however, on the cut quality.

For the front cut, the clamping unit can be inserted more or less deeply into the hollowed-out region of the plates. The printed product is only correctly supported when the clamping unit is guided deeply into the hollowed-out region of the plates. So that the printed product can be satisfactorily supported without changing the plates, only a small book width difference can be processed using the three-knife trimmer.

SUMMARY

In an embodiment, the present invention provides a device for carrying out cutting operations on at least one unbound formatting edge of at least one printed product. At least one cutter is configured to carry out each of a plurality of edge-related cutting operations. At least one transporter is operatively connected to a printed product-related advancing device for a first one of the cutting operations and to a printed product-related transporting device, which is operative after a last one of the cutting operations. The printed product is transportable from a first cutting location, at which the first cutting operation for a first formatting edge of the printed product takes place, to a second cutting location, at which a second one of the cutting operations for a second formatting edge takes place, and to a third cutting location, at which a third one of the cutting operations for a third formatting edge is carried out, after the second cutting operation at the second cutting location has been carried out. The at least one transporter includes a guide section such that the transport of the printed product from one cutting location to the next is carried out along the guide section. The at least one transporter includes a gripper with which the printed product is gripped by the spine and conveyable from one cutting location to the next in a suspended manner.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The printed product will in general be called a book block below, whereby there is then space to also deal with other types of printed products, for example brochures. The features and advantages of various embodiments of the present invention will become apparent by reading the following detailed description with reference to the attached drawings which illustrate the following.

DETAILED DESCRIPTION

Figure 1:
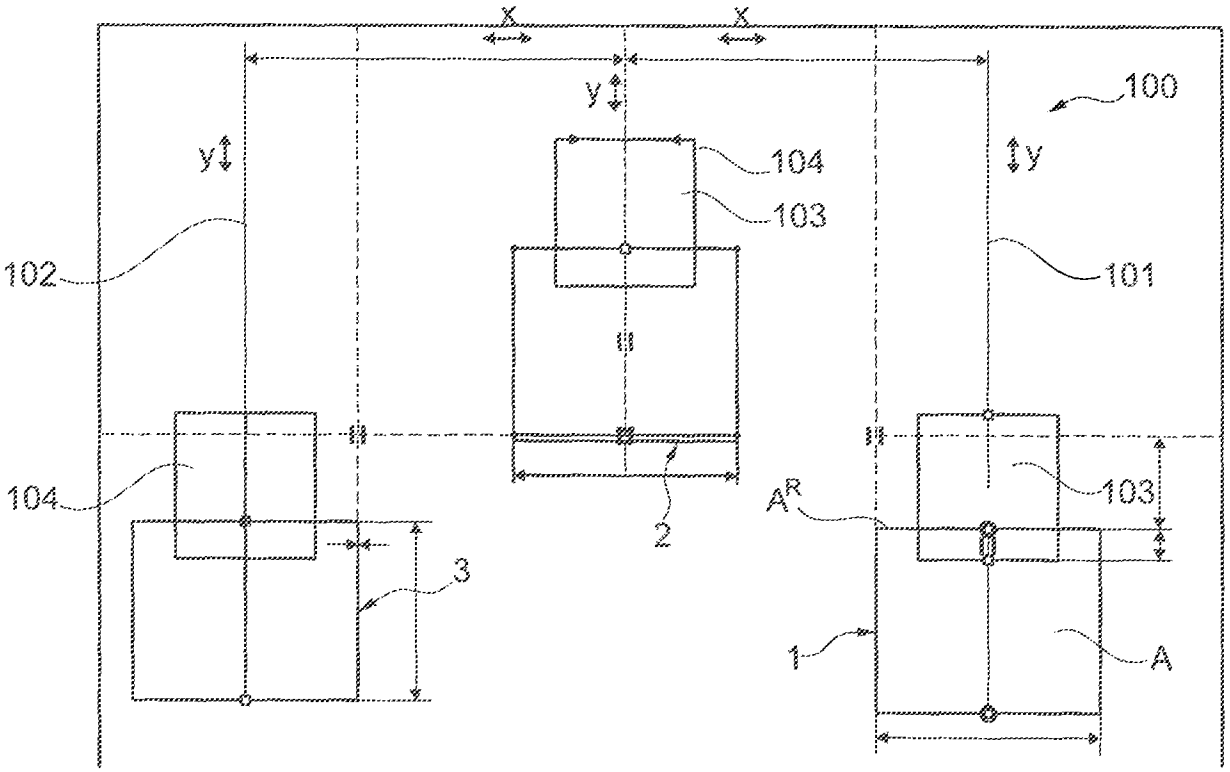
FIG. 1 shows translatory movements of the supports and grippers within the X- and Y-planes.

An embodiment of the present invention provides a device configured as a three-knife Another embodiment of the present invention provides a method for operating a device of this type configured as a three-knife trimmer. Embodiments of the invention provide to be able to continuously process printed products of the same or different formats and thicknesses, in other words to cut them to a defined format, with a high cutting output and cutting quality. The three-knife trimmer and the operation thereof according to embodiments of the invention are also suitable for cutting stacked brochures by the same procedure as is the case with a book block.

The three-knife trimmer is accordingly used to cut unbound formatting edges, also called the side edges of the printed product, such as, for example, books, brochures, magazines, the terms "printed products", or sometimes "book block" or "brochure", being predominantly used below for the sake of simplicity.

Reliable processing of very small runs down to a minimum piece number of one can be achieved by the three-knife trimmer according to the invention without having to provide downtimes due to a changeover from one format to the next. Thus, book block formats of different sizes can be fed to the three-knife trimmer and/or the production of book blocks can be processed by different portions to be cut off at the edges.

In accordance with an embodiment, the invention is achieved by a device in which the printed product is transported from a first cutting location, in which the cutting operation takes place for a first side edge, to a second cutting location, in which the cutting operation takes place for a second side edge, wherein the printed product, after the cutting operation at the second cutting location has been carried out, is transported to a third cutting location, in which the cutting operation for a third side edge takes place, and in that the printed product is transported from one cutting location to the next by at least one transport unit.

To maintain the efficiency of the three-knife trimmer according to the invention, the format changeover takes place while the machine is running, preferably during the time span available for transporting the printed product in and out.

In this case, the changeover from one format to the next has to take place with high precision so that each cut printed product satisfies the requirements with respect to the dimensional stability thereof.

Since the three-knife trimmer according to the invention can be used even with a run of one printed copy, the aim of the three-knife trimmer according to the invention must be seen in that the copy present only once is cut with 100% reliability.

A further substantial advantage of the invention can be seen in that the three-knife trimmer is simply constructed and designed to be operationally reliable, so that it can even be operated by auxiliary staff.

The three-knife trimmer according to the invention ensures that the dimensional stability of the cut printed product and the straight, parallel and right-angled cuts thereof are ensured with respect to the front and rear face of each printed product.

The three-knife trimmer according to the invention therefore ensures a high cut quality even in the case of relatively large printed product thicknesses, in that the printed product is clamped in a manner maximized over the whole area by at least one pressing device between the first and last side, while the cutting operations take place at the unbound side edges that are pending, so that during this cutting operation, the danger of a quality-reducing "nose formation" in the cut book block can be ruled out. The gripping of the printed product over whole area can, if necessary, be achieved by a plurality of pressing plates or, for example, by segmented pressing plates or individually operable pressing elements.

In this case, the printed products are fed horizontally, with the binding-processed spines leading and with an approximately equal separation over a conveyor belt to the three-knife trimmer. The approximately uniform separation is provided either by a clocked feed of the printed products to the conveyor belt of the three-knife trimmer, or a feed of this type is produced by devices and methods known per se upstream of the conveyor belt.

In another embodiment, the printed products are fed to the conveyor belt of the three-knife trimmer with an irregular separation. A clocking device ensures that minimum separations (distance between the edge the spine of the leading book and the edge of the spine of the following product) are not fallen below. A sensor detects when the printed product arrives on the conveyor belt of the triple cutter.

If the distance between the printed products is now greater than the minimum separation, it may be provided as the first preferred variant that the printed products located within the three-knife process are completed and thereafter advancing is resumed. As a further option, it may be provided that the speed of the three-knife trimmer is reduced by the controller and the three-knife trimmer is synchronized with the clock cycle of the printed product. If the separation then exceeds a maximum amount, it can also optionally be provided that the controller generates idle clock cycles at the three-knife trimmer.

The transport unit substantially consists of at least one support, which is equipped at the end with at least one printed product-related gripper, the gripper gripping the printed product to be cut at the spine of the book, so the printed product is conveyed in a suspended manner and the support and gripper being based on the following controller-assisted translatory movements with respect to the cutting locations:

i) accepting the printed product by means of the gripper of the support on completion of the first cutting operation at the first cutting location; ii) transporting this printed product by the same support/gripper to the second cutting location after the cutting operation at the first cutting location has taken place; iii) transporting the same printed product by the same support/gripper to the third cutting location for the third cutting operation after the cutting operation at the second cutting location has taken place; and thereafter iv) returning the support/gripper into the starting position at the first cutting location for a renewed acceptance of a subsequent printed product, after the first cutting operation at this cutting location has been carried out and completed.

As a further variant, the transport unit may consist of two printed product-related supports each having a gripper, which supports grip the printed product to be cut, also on the spine side of the book, in other words in a suspended manner, these supports with the associated grippers being operatively connected to one another, and the supports and grippers being based on the following controller-assisted translatory movements with respect to the cutting locations:

i) the first gripper of the first support accepts the printed product after the first cutting operation at the first cutting location has taken place; ii) the first support/gripper transports this printed product to the second cutting location, positions the printed product there to carry out the second cutting operation and then returns to the starting position at the first cutting location, where the renewed acceptance of a subsequent printed product takes place, after the first cutting operation at the first cutting location has been carried out there; iii) in the meantime, the second gripper of the second support accepts the printed product, directly after the cutting operation at the second cutting location has ended and transports it to the third cutting location, where the third cutting operation takes place; iv) thereafter, the second support returns with the second gripper to the second cutting location, where a printed product, which is already cut and has been subsequently brought by the first support/gripper is ready again to be fetched and transported by the second support/gripper to the third cutting location.

Both during operation with one and with two supports, generally the head portion is cut at the first cutting location, the front portion is cut at the second cutting location and the tail portion of the printed product is cut at the third cutting location.

A further transport unit of the printed products from one cutting location to the next consists in that at least two, three supports operate along a substantially round, oval, ellipse-like section, this functional peripheral section consisting of a front and a rear path substantially running in parallel, the two paths passing into one another by means of a lateral curvature in each case. The front path is used to guide the supports in a straight line or virtually a straight line along the cutting locations. The number of supports along the section depends on the maximum permissible clock cycle, i.e. each support is responsible for accepting a printed product and guides it without transfer in the sense of the above embodiments over the three cutting locations. To maximize production, the clock cycle is configured in such a way that the supports follow one another closely, and the distance from one another depends on the time required for the individual cutting operations, whereby generally more than two, three supports are used. A reduction in the number of supports can be achieved, for example, when they undergo acceleration along the rear path between the last and the first cutting operation. Thus, with an arrangement of this type, the intermediary cutting location-specific deliveries and acceptances of the printed product can be circumvented by supports travelling back and forth. On the other hand, in order to keep production high, more rotating supports generally have to be provided and, at the same time, the infrastructure of the ellipse-like section is generally more demanding.

A transport variant of this type characterized by an ellipse-like section is a good basis for centralized cutting of the printed products when, in other words, the three cutting operations are carried out at a single cutting location, i.e. when the acceptance of the printed product, its feed to the central cutting location, and its subsequent delivery take place by means of one and the same support. This support then advantageously does not travel back again via the front path, which would hinder the production flow, but undertakes the return journey to accept a new printed product via the rear path.

If cutting of all the formatting edges of the printed product takes place at a single central cutting location, the following kinematic sequences should preferably be provided:

As soon as the printed product has been properly positioned with an interlocking fit within a stationary clamping device, it is finally pressed by a pressing beam against the fixed wall of the clamping device and is therefore secured for the cutting operation. The pressing beam is preferably arranged at the lower end of a spindle, which has a drive connection to a servo motor, which is controlled by means of a line by a servo drive. The servo drive is connected by means of a further signal line to a sensor, which detects the position of the pressing beam.

By rotating the spindle, the pressing beam is moved in the direction of the printed product. The servo drive is moreover connected to a superordinate controller. Once the printed product is finally secured, it is then cut by a blade at the front edge and then by two side blades at the head and at the tail. The order of the cuts may also be reversed, head and tail cut before the front cut. It is obvious that the movement of the side blades and the associated pressing beams has to be phase-shifted with respect to the movement of the front blade and the associated pressing beam so that a collision of the blades can be prevented. In other words, as soon as cutting has taken place by means of the side blades, the local pressings (clamping device, pressing beam) are ended and the cut printed product is conveyed away.

This sequence is not imperatively predetermined per se in the three-knife trimmer according to the invention, in particular with regard to the processing sequence of the first and third cutting location, according to which sequence the first cutting always has to be the head portion, but it is readily possible to process the tail portion at the first cutting location and then the head portion at the third cutting location, the cutting of the front portion of the printed product continuing as before to take place at the second cutting location, this being to make the translatory movements, on which the invention is based, optimally sequence-related.

Whether the head or tail portion comes to be processed at the first cutting location depends on how the feeding of the printed product to the triple cutter is arranged, i.e. whether the side from which the printed product is read is directed upwardly or downwardly on the conveyor belt. In both cases, the spine edge of the printed product remains ahead during the transport to the triple cutter. If a reversal of this type (head/tail portion) is carried out, it has to be ensured that corresponding controller provisions are made for the portions to be cut off, in particular when the head and tail portions are to be processed with different cut lengths.

The translatory movements of the gripper or grippers accordingly include two or three working planes, namely:

- a first plane (X), which is characterized by the transporting of the printed product from one cutting location to the next;
- a second plane (Y), which is characterized by the loading and unloading of the printed product at the respective cutting location;
- a third plane (Z), which is characterized by a lateral adaptation (offset movement) of the support/gripper with respect to the stationary printed product-related clamping devices at the cutting location, this lateral adaptation being fixed, or being able to be optionally controlled for use.

The gripper itself is equipped at the end with printed product-related clamping jaws, said gripper or the support(s) at the cutting locations having an additional translatory degree of freedom in all the above-mentioned planes (X, Y, Z). In this case, the gripping of the respective printed product is maximized at the center of gravity thereof, and/or the gripping of the printed product, depending on the portions to be cut off at the unbound side edges (head, front, tail) coincides with the best possible geometric location, an average to strong deviation with respect to the theoretical center of gravity of the printed product being possible in the case of the last mentioned option.

Basically, a clamping device can be operated according to the following criteria:

a) the clamping jaws belonging to a clamping device are directly or indirectly operatively connected to a drive operating for the frictional clamping action, the clamping jaws guided by the drives having an adjustable and/or predictively controlled lifting and frictional connection profile, which are aligned with any desired formatting configuration of the respective printed product to be processed. Thus, the printed product can be symmetrically or virtually symmetrically gripped with respect to the center line of the spine of the printed product by the frictional movement profile carried out by the clamping jaws. Furthermore, it can be achieved that using the clamping jaws, at least during the operative phase, a clamping force can be exerted on the printed product by a mutually matched uniform, non-uniform or adaptive speed and/or movement profile.

b) The mutually matched uniform, non-uniform or adaptive speed and/or movement profile of the two clamping elements of a clamping device can also be provided for a one-sided exertion of pressing force of an individual pressing element. In the sense of a quality assurance of the cutting operation, this relates to the pressing beam, which has a direct operative connection to the blades in such a way that its exertion of pressing force on the printed product has to proceed according to specific criteria. The speed profile of the pressing beam can be transferred to a different mode directly after the first contact with the printed product. This also applies with respect to the further development of force on the printed product which, depending on the input, may be successively monotonic or virtually monotonic, increasing or falling. If, in the development of force, a certain flexion is required toward the end of the pressing, for example, to protect the generally slightly thickened spine portion of the printed product, this can be provided with the activation of a corresponding control profile, according to which, for example, the monotonically increasing development of force can pass into a curve according to the principle of a capacitor charge. Accordingly, it is then readily possible to provide an exponential development of force, which is used in an intermediary or overarching manner.

The cutting stations of the three-knife trimmer, at each cutting location, are operatively connected to at least one stationary, virtually stationary or movable force-producing clamping device, which is responsible for the basic gripping and production of the pressing force on the printed product to be cut, said clamping device being matched to the format size of the printed product, in other words being able to have an optimized fixed pressing face, or, in the course of operation, being able to adjust by simultaneous adaptations to the respective format size of the printed product.

The exertion of force, in other words the pressing force to be introduced, of a clamping device of this type onto the printed product during the cutting operation acts in terms of force predominantly with respect to the closing force being exerted by the clamping jaws of the gripper on the printed product in such a way that said printed product remains rigidly positioned during the whole cutting operation owing to the pressing force emanating from the respective clamping device.

The closing force of the clamping jaws of the gripper, as long as this remains at the location of the cutting operation, does not influence the pressing force of the clamping device and its vectors on the printed product. This means that the pressing force of the clamping device behaves absolutely predominantly in terms of the action and forces with respect to the closing force of the clamping jaws of the gripper.

At least one clamping device within the three-knife trimmer may consist of two clamping plates, which carry out at least one force-exerting closing movement with respect to one another. Furthermore, at least one further clamping device can consist of individual connected pressing strips at a suitable cutting location, which exert pressing force on the pressing faces of the printed product, these pressing strips collectively forming a pressing strip battery.

According to the invention, an advancing device (also called an insertion wheel or star-shaped wheel because of its configuration) firstly has a direct operative connection to the first cutting operation at the first cutting location. Basically, this advancing device has the shape of a four-part wheel, other divisions also being possible. If the conveying of a connected book block is pending, the mode of functioning of a four-part advancing device of this type is as follows:

During a first 90° rotation of the advancing device, a foldable rake-like guide is pivoted against the book block in such a way that said book block lies on its spine after the 90° rotation and is protected against fanning out and/or falling over. The rake-like guide is coupled to a clamping assembly, which acts within the advancing device, which briefly clamps the book block in a position lying on its spine. This clamping assembly is designed in terms of movement kinematics in such a way that the rake-like guide is transported into a book block thickness-dependent position. In this position, the clamping assembly produces a small opening, so that the book block, following gravity, is aligned at its spine on a stop face within the corresponding station of the advancing device. The clamping assembly then closes again, whereupon the book block is held in a defined position for the further processes.

The advancing device, in other words the insertion wheel, thereupon rotates further by two clock cycles through 90° in each case and brings the book block into a now suspended position. During this rotary movement, the first rake-like guide and a second guide that is operatively connected are pivoted away from the book block in such a way that the free pages or signatures of the book block are suspended vertically downward solely by gravity, while the book block is held in the region of its spine by said clamping assembly.

The advancing device of the device according to the invention for printed products, which also consist of two or more brochures, can also be formed by a four-part advancing device of this type, the mode of functioning of said advancing device then being as follows:

During a first 90° rotation of the advancing device, a foldable rake-like guide is pivoted against the brochures in such a way that the brochures, after the 90° rotation then lie on their spines and are thus protected against fanning out and/or falling over. The rake-like guide is coupled to a clamping assembly, which acts within the advancing device, which briefly clamps the brochures in a position lying on their spines; this clamping assembly is kinematically designed in such a way that the rake-like guide is transported into a thickness-dependent position. Thereafter, the clamping assembly opens a little again, so that the brochures, following gravity, are aligned at their spines on a stop face within the advancing device and/or, during this process, additional mechanical and/or vibration-triggering means intervene, which align the brochures to form a block that is uniform with respect to format. The clamping assembly then closes again, whereupon the brochures are held in a defined position.

The advancing device thereupon rotates further by two clock cycles through 90° in each case and brings the brochures into a now suspended position. During this rotary movement, the first rake-like guide and a second guide that is operatively connected is pivoted away from the brochures, so the free pages or signatures of the brochures are suspended vertically downward solely by gravity, while the brochures are held in the region of their spines by the clamping assembly.

On the other hand, this advancing device is operatively connected in the region of the first cutting location to a movable transport clamp equipped with clamping plates, which carries out the function of the clamping device, and which accepts the printed product from the advancing device according to the kinematics described above and feeds it to the first cutting operation.

An aligning device is operatively connected to the advancing device, and is to serve as a supplement to the measures already described to achieve a secure positioning of the book block with respect to the stop faces thereof.

A stop face, on the one hand, both in the case of individual books and in the case of a stack of brochures, is used as a basis for the alignment of the spine side of the printed products with respect to a fixed support face within the advancing device. On the other hand, it has to be ensured that on the head and/or tail side of the printed products, a corresponding, suspended elongate positioning of the printed products in the flow direction is ensured before the first cutting operation.

In the case of individual books, this takes place in that the acceptance of the individual book in accordance with the format from the advancing device by means of the transport clamping device is guided by a sensor, which is disposed on the outer edge of the overhanging wrapper or the book block itself in the region of the portion on the head or tail side. This means that the sliver cut there in the book block has a matched size.

In the case of a stacked package of individual brochures, before the first cutting operation, lateral means have to be provided, which ensure a uniform alignment of the cutting location-side edges of said package.

To summarize, the function of the advancing device consists in pivoting a foldable, rake-like guide against the book block, so that, after a 90° rotation, lying on its spine, it cannot fan out and cannot fall over. The rake-like guide is coupled to a clamping assembly, which briefly clamps the book block in a position lying on its spine and is kinematically designed in such a way that this rake-like guide can be transported into a book thickness-dependent position. Thereafter, the clamping assembly opens a little again, so that the book block or the brochures, following gravity, has the possibility of being aligned at its book block spine side in accordance with the stop face of the advancing device. The clamping assembly then closes again, whereupon the book block is held in a defined position.

This procedure that has been optimized per se accordingly provides assurance that the spine sides of the printed products adopt a defined position, which is decisive for the subsequent cutting operations.

Regardless of this, it is appropriate in terms of quality if additional measures (aligning devices, acting in the vertical and horizontal plane) are provided, which are to intervene in those cases when in a different configuration of the printed product, in particular the book block spines thereof, the use of gravity alone is not sufficient to ensure the desired defined position of the spine side of the book block with respect to the associated stop face.

In this connection, the fact has to be considered that the printed products, in particular the book blocks, are provided with a wrapper in most cases, which on all sides (head, tail, front portion) has a relatively large overhang with respect to the body enclosed. This overhang does not per se present restrictions for the cutting process but, however, has to be detected with additional sensors in order to cut the printed product precisely within the various cutting operations. For logistic reasons, wrapper sizes that are as equal as possible are advantageously operated with, whereby a large bandwidth of various book block formats can be detected. It is thus to be assumed that for the most part a comparatively large overhang is to be operated with.

In order to bring about the secure defined position between the book block spine side and the stop face within the advancing device even in the case of wrappers having a large overhang in the region of the head, tail and front portions, it is proposed for the enhancement according to the invention of the prior art, during the short opening of the clamping assembly to use the gravity on the printed product, to additionally intervene with at least one adequate aligning device, which can exert the necessary pressing force via the wrapper overhangs directly or indirectly on the enclosed printed product, so that at least the spine side of the printed product rests securely on the associated stop face.

For this purpose, the two front-side wrapper overhangs of the book block are gripped by a brush comb that is optimally angularly aligned in the pressing plane or by other flexible mechanical or pneumatically activated means, so that the resulting pressing force transfers via wrapper overhangs onto the body of the printed product in such a way that said printed product then rests securely on the stop face arranged within the advancing device.

Using the example of a brush comb, the flexibility thereof in terms of material is configured in such a way that the free resulting sub-region of the brush comb between the two wrapper overhangs can additionally advance owing to the vertical or virtually vertical pressing movement to the front portion of the book block in order to there be able to develop an additional or predominant pressing force.

Basically, this procedure can also be provided when it is a question of forming a lateral pressing force achieved by adequate means on the head or tail portion of the printed product to form a uniform plane, even when the package consists of various brochures, so this uniform edge then receives that optimal positioning within the transport clamp device by means of a sensor.

The clamping device at the second cutting location, according to the invention, as already mentioned above, includes pressing strips, which are arranged on both sides of the pressing faces of the printed product, and which pressing strips simultaneously or subsequently press the printed product at least from one side.

The number of pressing strips being operatively used on both sides is in each case established in terms of control depending on the format size of the printed product to be processed, it also being possible for the cutting strips freed for use to carry out movements directed against one another to exert the pressing force on the printed product, whether with the same force or by a controlled stepped development of force.

During a subsequent action of the pressing strips on the printed product, the pressing action, i.e. development of the pressing force, starts with the first pressing strip in the region of the spine of the printed product to then carry on continuously by a subsequent or semi-subsequent sequence until approximately in the region of the front edge to be cut.

The subsequent activation of the pressing strips along the format of the printed product also means that the air caught between the pages or signatures of the printed product is continuously pressed out until a complete thickness consistency of the book block is achieved. Only then can, in particular, the cutting operations directed at the front edge of the printed product be carried out successfully. This procedure can also be carried out in the remaining cutting operations with corresponding clamping devices.

Regardless of which type of clamping device is used, whether with the aid of clamping plates or pressing strips, the printed product is additionally finally pressed by the use of pressing beams in the direct region of the cutting operations, which means that ultimate optimal conditions for the cutting operation are achieved.

A further force-exerting clamping device, which is constructed in accordance with a four-clamp system, another division also being possible, is in use in the region of the third cutting operation at the third cutting location. So as not to trigger any linguistic conflicts compared to the clamping devices already discussed, a four-clamp system is referred to hereinafter. Said four-clamp system can simultaneously, directly or indirectly, fulfill the function of a printed product-related transporting device.

Said four-clamp system of the device according to the invention, which can receive both book blocks and brochures and can provide for the further processing, is operated according to the following criteria:

The book blocks or brochures introduced into the four-clamp system for the third cutting operation are pressed during the cutting process at the third cutting location between a movable clamping jaw belonging to the four-clamp system and a fixed clamping jaw.

After the cutting operation at this third cutting location has been carried out, the rotatable four-clamp system moves through 90° during each clock cycle and therefore a clamp with the book block or the brochures also moves orthogonally with respect to the blade movement at the third cutting location away from the blade. In this position, the book block or the brochures are then transported out by the four-clamp system and passed to a conveyor belt.

The cutting operations at the cutting locations of the three-knife trimmer, with regard to the cutting of the individual unbound side edges of the printed product, are carried out using an individually driven cutting device in each case, at least one cutting device being operated with a singly-acting cutting blade.

Said cutting device is preferably modularly constructed and it consists of at least three cutting stations to cut the head, front and tail edge of the book block, which are arranged at the cutting stations in a U-shape with the open side downward. The cutting operations are then operatively connected to at least one locally arranged pressing beam in each case, the pressing beam acting against the inner planes of the U-shape. Owing to this downwardly-directed U-shaped configuration, the cut portions of the book block or the brochures all drop down.

Moreover, the three-blade trimmer according to the invention has the following advantages with respect to the known three-blade trimmers.

During the individual cutting operation, the printed product is pressed by variously configured clamping devices (clamping plates or pressing strip batteries), with an additional pressing action by the pressing beams already mentioned, so that the printed product is gripped virtually over the whole area at each cutting operation. Only in the region of the spine is the printed product not gripped. This is not critical because the spine binding being used in each case (thread stitching, adhesive binding, saddle stitching, etc.) sufficiently holds the printed product together in this region, while the clamping plates or pressing strips being used sufficiently support the printed product integrally. This pressing of the printed product over the whole area in cooperation with the pressing beams being used are the prerequisites for achieving a high cut quality.

Accordingly, the pressing of the printed product which is almost over the whole area according to the invention is achieved in the simplest manner. No format-dependent webs, support elements or support strips have to be provided. As a result, a high output density with a high clock cycle number can be achieved with the three-knife trimmer according to the invention.

As the printed product is transported in a suspended manner to the individual cutting stations of the cutting device with the three-knife trimmer according to the invention, no support of the sides of the printed product is necessary at the transfer points in the transport system.

Because the printed products are not transported horizontally, the book sides also do not bend between the support points in the case of support faces that are not over the whole area, and they can therefore not catch on the transfer points provided.

The three cutting stations of the cutting device are U-shaped with the open sides of the U directed downwardly. The portion length to be cut off at the edges, in other words at the unbound sides, of the printed product is provided in all three cutting operations (head, tail, front side) toward the interior of the U-shape. As a result, a single disposal device can be operated with, whereupon all the falling cuttings can be "transported out" together. The cuttings drop down without further aids owing to gravity, where they can be globally collected or continually transported away.

Good disposal of cuttings is therefore very significant, because in the industrial production of individual printed products (book blocks), the different formats are often first produced on the three-knife trimmer. In this case, the printed products are fed to the three-knife trimmer in a size matched to the largest end format, which of course leads to large portions to be cut off in the case of end formats which have to be made very much smaller.

In a case of three-knife trimmers having cutting cassettes and pressing punches, it is meanwhile conventional to align the printed product by two right-angled stops in the corners formed by the spine and the head side and the spine and the tail side, as well as a stop from the book block front side. When producing printed products (book blocks) of various formats, for a specific format range, wrappers of the same format are generally used.

Said pressing beam is therefore directly operatively connected to the respective cutting blade and ensures that that force which is imperative for a clean cut is exerted on the printed product.

Basically, two main variants are predominant: on the one hand, a coupling in terms of force exists between the pressing beam and cutting blade, i.e. the pressing beam force accordingly has a fixed value, the speed profile (pressing speed/acceleration) then also generally running monotonically.

Another variant consists in decoupling the force exertion of the cutting blade and pressing beam with respect to one another, so that the pressing beam then operates according to the following criteria:

The build-up of a specific force at the pressing beam takes place by the build-up of a corresponding torque at the servo motor by a servo drive. Based on the thickness measurement, the optimal pressing force on the printed product is determined, which can take place easily by means of stored control profiles. Generally, a single calibration is sufficient to detect a specific thickness variability of the printed product, as long as the pressing force characteristic on which it is based can be regarded as constant, because the differences in the book block thicknesses within a job are relatively small.

In contrast, it has to be considered however that a substantial reduction in the pressing speed and in particular the acceleration is to be provided by optimizing the pressing lift, particularly in the case of stiff and/or thin printed products. With this concept, however, it is advantageous that regardless of the production speed, the respective cutting device(s) always work at the maximum speed, which is not limited here by the cutting speed, but by the limits determined by the mechanics. It is also important that with a low machine speed, an increased cycle time is available, in particular for the transporting, aligning and pressing operations, as the same amount of time is always required for the cutting process.

If the thickness of the printed products now varies within a certain framework and these are produced by fixed edge processing, the wrapper at the uppermost side of the printed product does not project by an equal amount as on the last side thereof. If the height of the printed product varies, the wrappers project more or less with respect to the printed product accordingly. Generally, the printed products are produced with a fixed overhang of the wrapper on one side and a variable overhang on the other side. In products of this type, the alignment of the book block, as is the case in the three-knife trimmers having cutting cassettes and pressing punches, is unsuitable.

In contrast, in the three-knife trimmer according to the invention, the printed product that is still uncut is aligned at the tail or head edge and the spine edge. Thus, the variable overhangs of the wrapper with respect to the width, at most also the height, of the printed product are not an issue.

For each printed product to be cut, product data has to be known to the controller of the three-knife trimmer, from which the necessary movements of the transport members can be calculated, so that ultimately a cut printed product is produced that has the desired format dimensions.

These data can be transmitted to the controller in many different ways. Some possibilities are listed by way of example below:

Each printed product is equipped with an identification feature. A feature reader at the entry to the three-knife trimmer reads the identification feature (for example one-dimensional or two-dimensional, RFID chip, sign, picture, etc.) and transmits the information from the feature with the machine clock cycle allocation to the controller. The feature may contain the necessary information which maps the cut printed product dimensions, or the information which is lacking can be supplemented from control profiles stored in a database.

In another system, the printed products are fed to the three-knife trimmer in a clocked manner. With each clock cycle, the controller of the three-knife trimmer is also supplied with the information necessary in order to cut the printed product to the correct dimensions. Here too, data supplied with the printed product can be supplemented by data from a database.

A further possibility is that the data with the order of the printed products is made known to the three-knife trimmer before the feeding thereof takes place. The three-knife trimmer processes the next dataset in the predetermined order with each printed product that is fed in. The feeding of the printed products must take place here in the correct order. A feature reader, which controls the order, can additionally be used for control.

As already described above, the printed products are fed horizontally to the three-knife trimmer via a conveyor belt, with the side processed by thread stitching, adhesive binding, saddle stitching, etc. leading and with approximately the same separation. The approximately uniform separation is either provided by a clocked feeding of the printed products to the conveyor belt of the three-knife trimmer, or it is produced by devices and methods known in the art upstream of the conveyor belt.

In another embodiment, the printed products are fed to the conveyor belt of the three-knife trimmer with an irregular separation. A clock cycle device ensures that minimum separations (distance of the book spine edge from the book spine edge of the next product) are not fallen below.

A sensor detects when a book block arrives on the conveyor belt of the three-knife trimmer. If the distance between the book blocks is now greater than the minimum separation, it can be provided as the first preferred variant that the printed products located within the three-knife process are completed and thereafter the advancing is resumed.

It may be provided as a further option that the speed of the three-knife trimmer is reduced by the controller and the three-knife trimmer is synchronized to the clock cycle of the printed product. If the separation exceeds a maximum amount, it can also optionally be provided that the controller generates idle clock cycles at the three-knife trimmer, as has already been described above in connection with the operation of the advancing device.

FIG. 1 schematically shows the translatory movements of a transport unit, which belongs to a three-knife trimmer 100, the movements of which are carried out from two printed product-related movable supports 101, 102, these supports, as will be shown in more detail later in the description of the other drawings, being operatively connected to one another. The supports have printed product-related grippers 103, 104 at the end with clamping jaws, which successively grip the printed product A to be cut on the book spine side $A^R$. The supports themselves carry out the following matched controller-assisted translatory movements with respect to the cutting locations 1, 2, 3, also called cutting stations:

The first support 101 actively accepts the printed product A once the first cutting operation at the first cutting location 1 has taken place. The first support then transports this printed product A to the second cutting location 2 and returns, after the delivery of the printed product has been completed, to the starting position at the first cutting location 1 for the renewed acceptance of a subsequent printed product A, this being after the first cutting operation at the first cutting location 1 has been carried out. In the meantime, the second support 102 accepts the printed product A directly after the cutting operation at the second cutting location 2 has ended and transports this printed product to the third cutting location 3, where the third cutting operation takes place. Thereafter, the second support 102 returns to the second cutting location 2, where a further printed product A, which is already cut and has been brought by the first support is ready again to be fetched and transported to the third cutting location 3.

The translatory movements of the supports 101, 102, with the attached grippers 103, 104, include two or three planes: namely, in the first plane X, the transport of the printed product from one cutting location to the next is carried out; in the second plane Y, the loading and unloading of the printed product is completed at the respective cutting location. Optionally, a third plane Z is then also used in which, as required, a lateral adaptation (offset movement) with respect to the printed product-related stationary clamping elements takes place at the respective cutting location of the three-knife trimmer 100.

The action of the translatory movements of the supports with the aid of the grippers will be described below as these best represent the operations within the three-knife trimmer.

Figure 2:
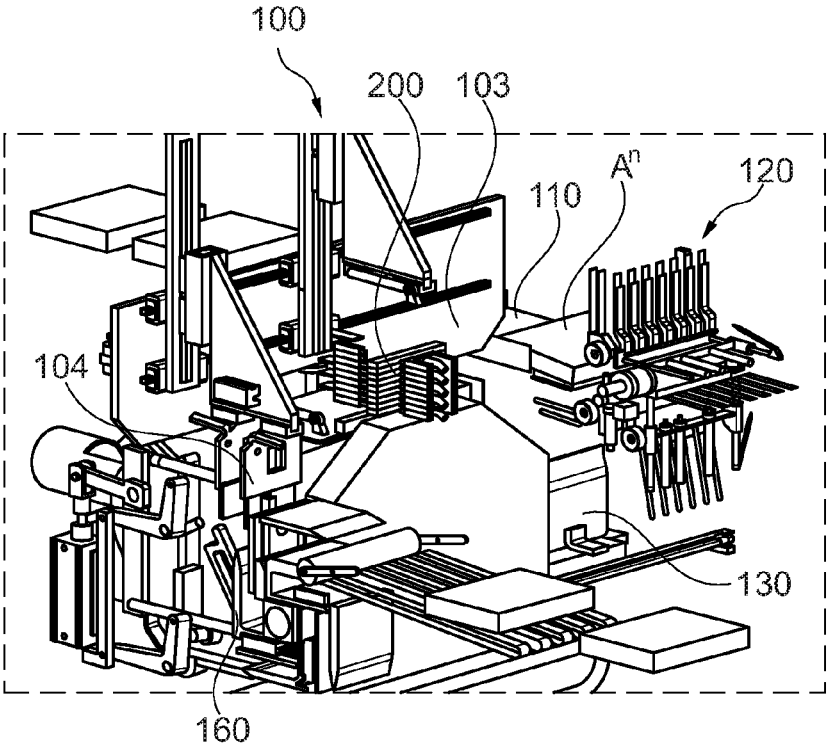
FIG. 2 is an overall view of the three-knife trimmer with a snapshot of the supports.
Figure 3:
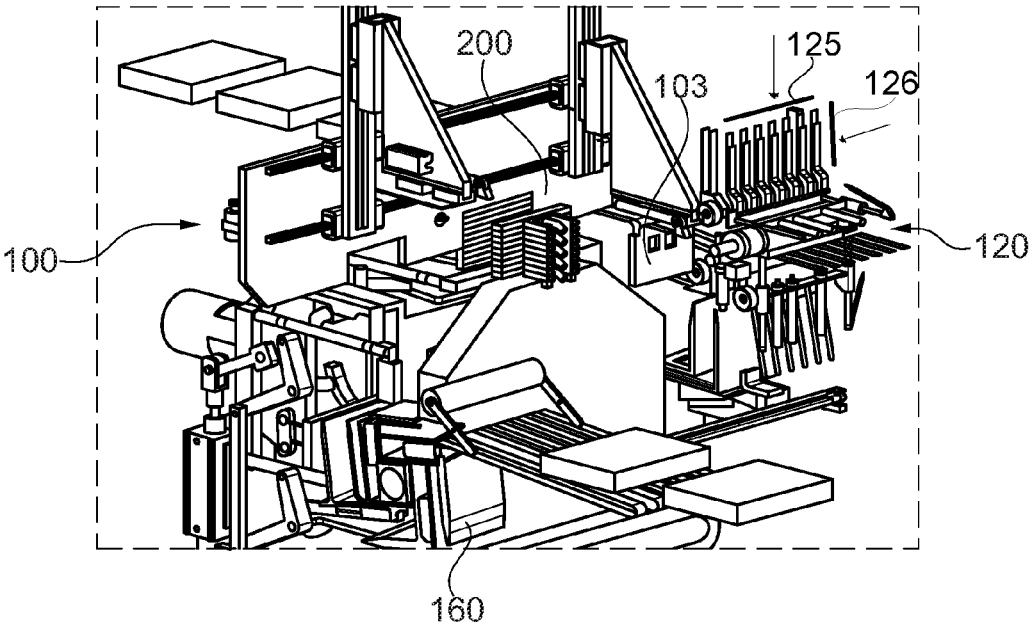
FIG. 3 is a further view of the three-knife trimmer with a further snapshot of the supports.

FIGS. 2 and 3 show the three-knife trimmer 100 in a 3D view. The book blocks $A''$ are fed to the three-knife trimmer 100 horizontally, with a book block spine leading and with an approximately equal separation, by means of a conveyor belt 110. The approximately uniform separation is either provided by a clocked feed of the book blocks to the conveyor belt of the three-knife trimmer, or it is produced by devices, which have become known from the prior art, upstream of the conveyor belt.

In another embodiment, the book blocks are fed with an irregular separation to the conveyor belt 110 of the triple cutter 100. A clocking device ensures that minimum separations (distance of a leading book spine edge from the spine edge of the next book block) are not fallen below.

That instant at which a book block arrives on the conveyor belt of the three-knife trimmer is detected by a sensor. If the distance between the book blocks is now greater than the minimum separation, the speed of the translatory movements of the three-knife trimmer is reduced by the controller, whereupon the three-knife trimmer is synchronized to the clock cycle of the delivered book block. If the separation exceeds a maximum amount, the controller is programmed in such a way that it is in a position to generate idle clock cycles at the three-knife trimmer.

The book blocks $A''$ are aligned on the conveyor belt 110 on the head or tail side by a fixed stop. This may take place by means of a transport section having transport rollers that are slightly inclined, or by other methods that have become known from the prior art.

The remaining modules of the three-knife trimmer according to the information in FIGS. 2 and 3 are described in detail in the following drawings.

An aligning device 125 (see FIGS. 3 and 14) is operatively connected to the insertion wheel 120 (advancing device), and is to serve as a supplement to the measures already described to achieve a secure positioning of the book block with respect to its stop faces.

A stop face is taken as a basis, on the one hand, both in the case of single book blocks and in the case of a stack of brochures for the alignment of the spine side of the printed products with respect to a rigidly predetermined support face within the insertion wheel 120. On the other hand, it has to be ensured that the head and/or tail side of the printed products have a corresponding suspended elongate positioning in the flow direction prior to the first cutting operation.

In the case of book blocks, this occurs in that the acceptance in terms of the format of the individual book by the insertion wheel 120 by means of the transport clamping device 130 is controlled by a sensor, said sensor responding to the outer edge of the overhanging wrapper or of the book block itself in the region of the head-side or tail-side portion. This means that the edge zone cut there in the book block has a matched size.

In the case of a stacked package of individual brochures, lateral means, which ensure a uniform alignment of the cutting location-side edges of said package, should then preferably be provided prior to the first cutting operation.

The function of the insertion wheel 120 accordingly consists in pivoting a foldable, rake-like guide against the book block, so that, after a 90° rotation, lying on its spine, cannot fan out and cannot fall over. The rake-like guide is coupled to the clamping assembly, which briefly clamps the book block in a position lying on its spine and is kinematically designed in such a way that this rake-like guide can be transported into a book thickness-dependent position. Thereafter, the clamping assembly opens a little again, so that the book block, as a result of gravity, has the possibility of being aligned with its book block spine side in accordance with the stop face of the insertion wheel. The clamping assembly then closes again, whereupon the book block is held in a defined position.

This procedure, which is optimized per se, accordingly provides assurance that the book block spine side adopts a defined position, which is decisive for the subsequent cutting operations.

Regardless of this, it is appropriate in terms of quality if additional measures are provided, which are to intervene in those cases when in various configurations of the book block, in particular the book block spines thereof, the use of the gravity component alone is not sufficient to ensure the desired defined position of the book block spine side with respect to the associated stop face.

In this connection, the fact has to be considered that the book blocks are provided in most cases with a wrapper, which on all sides (head, tail, front portion) has a relatively large overhang with respect to the original book block body. This overhang does not per se present any restrictions for the cutting process which, however, provides logistic advantages because of unification, inasmuch as a large bandwidth of various book block formats can be gripped with the same wrapper size. It is therefore to be assumed that the relatively large overhang will be used for the most part.

In order to bring about the secure defined position between the book block spine and the stop face within the insertion wheel 120 even with wrappers having a large overhang in the region of the head, tail and front portions, it is proposed for the enhancement according to the invention of the prior art, during the short opening of the clamping assembly, in order to allow gravity to act on the book block, to operate at least with one aligning device 125, 126 (see FIGS. 14, 15) with a suitable form, which can exert the necessary pressing force via the wrapper overhangs directly or indirectly on the book block so that the book block spine side rests securely on the associated stop face or is laterally aligned.

For this purpose, the two front-side wrapper overhangs of the book block are gripped by brush combs optimally angularly aligned in the pressing plane (see FIGS. 14, 15) or by other flexible mechanical or pneumatically activated means, so that the resulting pressing force is transferred via wrapper overhangs to the body of the book block A in such a way that it then rests securely on the stop face arranged within the insertion wheel 120 or is otherwise horizontally positioned.

Using the example of a brush comb (see FIGS. 14, 15), the flexibility thereof in terms of material is achieved in such a way that the free resulting sub-region of the brush comb between the two wrapper overhangs can additionally advance to the front portion of the book block owing to the vertical or virtually vertical pressing movement in order there to be able to develop an additional or predominant pressing force.

Basically, this pressing force can also be provided when it is a question of generally exerting a lateral pressing force on the head or tail portion of the printed product by adequate means in the form of a further aligning device 126 (see FIGS. 3 and 15), with the aim of bringing about the formation of a uniform plane over all the printed products of the package, such that this edge can then be safely detected by a sensor in order to be able to set up that optimal positioning within the transport clamping device 130, such that the subsequent cutting operations (head and tail) can be carried out with the correct measurements.

Figure 4:
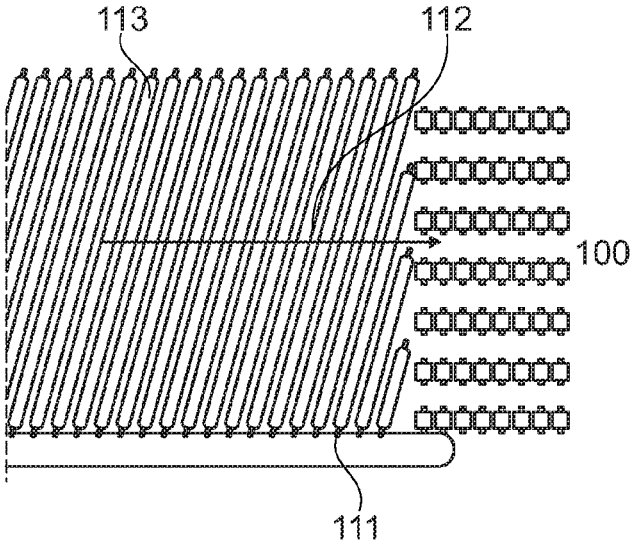
FIG. 4 shows an infeed device for the book blocks into the three-knife trimmer.

As emerges in this regard from FIG. 4, the book blocks are pressed by slightly inclined transport rollers 113 in the transport direction 112 against a fixed stop 111 and are then forwarded to the three-knife trimmer 100. The fixed stop 111 may be configured with a co-running belt, or else only as a fixed plate.

The book blocks A″ then arrive in a transfer position, from which they are lifted for example by a rotating insertion wheel 120 and brought into position by rotation.

Figure 5:
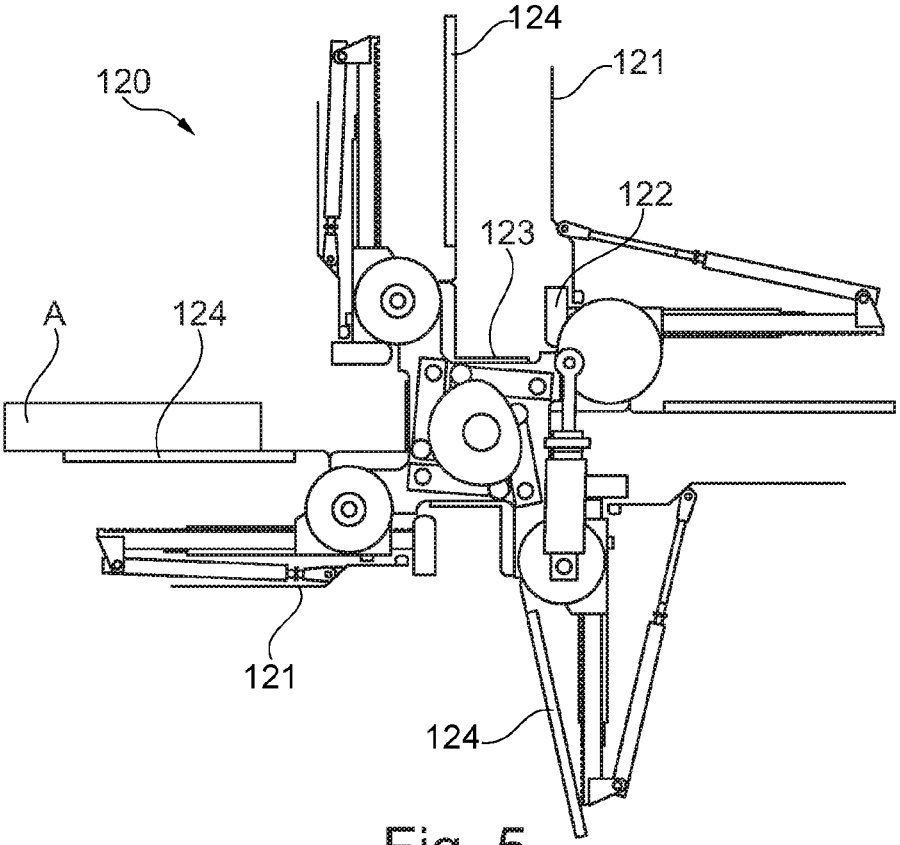
FIG. 5 shows an insertion wheel as an advancing device.

As emerges in this regard from FIG. 5, during a first 90° rotation of the insertion wheel 120, which fulfills the function of an advancing device with respect to a subsequent operation, a foldable rake-like guide 121 is pivoted against the book block A, so that the book block, after the 90° rotation, lying on its spine, cannot fan out and cannot fall over. The rake-like guide 121 is coupled to a clamping assembly 122, which briefly clamps the book block in a position lying on its spine, and which is kinematically designed in such a way that the rake-like guide 121 can be transported into a book thickness-dependent position. Thereafter, the clamping assembly 122 opens slightly again, so that the book block A, following gravity, has the possibility of being aligned on its book block spine in accordance with the stop face 123 of the insertion wheel 120. The clamping assembly 122 then closes again whereupon the book block is rigidly held in a defined position. The four-part insertion wheel 120 now rotates further through 90° in each case over two clock cycles and generally secures the printed product in a now suspended position for further processing. During this rotary movement, the first rake-like guide 121 and a second rake-like guide 124 that is operatively connected thereto are easily pivoted away from the book block, so that the pages of the block are suspended vertically downward solely as a result of gravity, while the book block is held on the book block spine by the clamping assembly 122.

In this position, an opened transport clamp (clearly visible in FIG. 2, pos. 130) travels horizontally in the direction of the book block spine over the book block itself and accepts it over the whole area.

Figure 6:
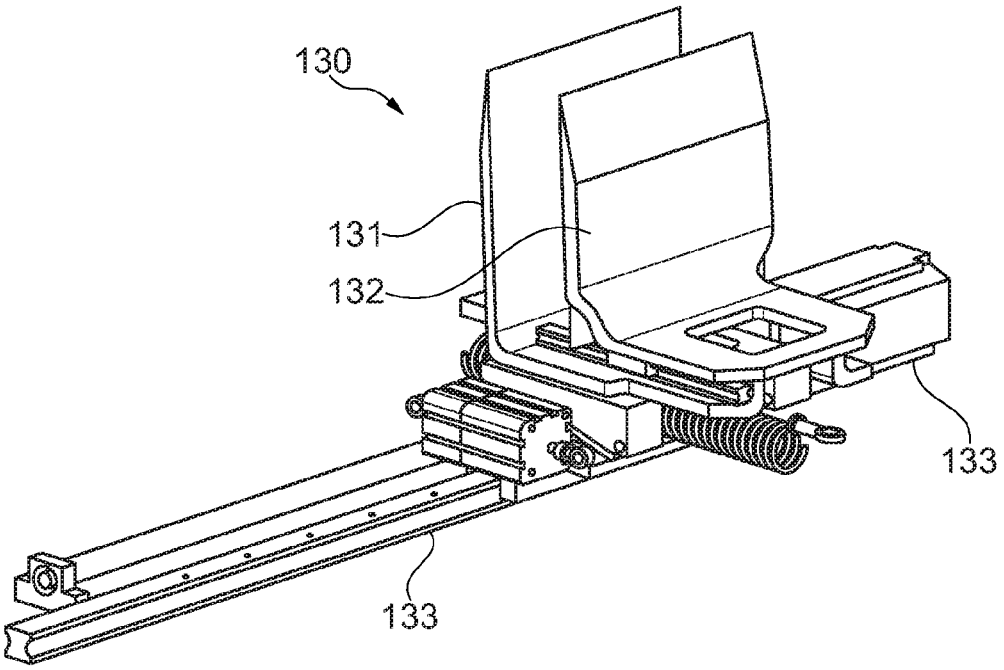
FIG. 6 shows a transport clamp.

As emerges in detail in this regard from FIG. 6, this transport clamp 130 consists of two clamping jaws 131, 132. The transport clamp preferably operates in such a way that the one clamping jaw 131 does not carry out a lift, while the other clamping jaw 132 carries out the entire lift. The two clamping jaws 131, 132 together travel two different offsets which are connected whether the printed product in general is transported or an idle journey is made.

Optionally, it may be provided in the case of certain variable and/or inconsistent book block thicknesses that the lift of the two clamping jaws 131, 132 of the transport clamp 130 is designed individually and accordingly the same or different paths are travelled until the end pressing position is completed.

The transport clamp 130 can be moved horizontally by a linear movement device 133. A controlled drive moves the transport clamp 130 with precision with respect to an acceptance position in conformity with the book block. This acceptance position always depends here on the portion to be cut off, which is to take place at the head or tail side of the book block. In the acceptance position, the transport clamp 130 then closes and, in the process, clamps the book block between its front and rear face over the whole area. Only the spine region and the respective region to be cut off of the book block remain free. For this purpose, reference is made to the description of FIG. 12.

The clamping assembly 122 (see FIG. 5) now opens and releases the book block spine. The transport clamp 130 thereupon moves horizontally and transports the book block into the first cutting position (see also FIG. 1, pos. 1) of a modularly constructed multi-cutting device.

The two clamping jaws 131, 132 can also be operated according to the following criteria: each clamping jaw is directly or indirectly operatively connected to a drive operating for the frictional clamping action. The clamping jaws guided by the drives have an adjustable and/or predictably controlled lifting and frictional connection profile with respect to any format configuration of the presented printed product, so that the frictional gripping of the printed product achieved by the clamping jaws is configured for symmetry or virtual symmetry with respect to its center line. The clamping jaws, at least during the operative phase for exerting the clamping action on the printed product, carry out a mutually matched uniform, non-uniform or adaptive speed profile. This operation can be provided for all the clamping jaws operatively connected to one another, which are a component of this application.

Figure 7:
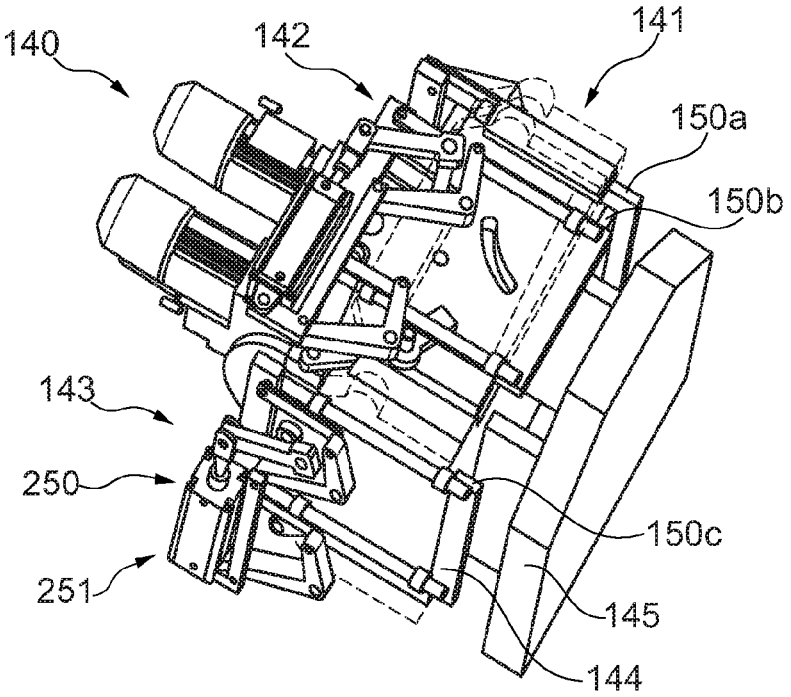
FIG. 7 shows a modular cutting device containing the three cutting stations.

As emerges in this regard form FIG. 7, the modular cutting device 140 comprises three cutting stations, which consist of a first station 141 at cutting location 1 (see FIG. 1), a second station 142 at cutting location 2 (see FIG. 1) and a third station 143 at cutting location 3 (see FIG. 1). For the respective cutting operation, the book block is pressed by a pressing plate 145 and additionally with a pressing beam 144 in such a way that the book block is clamped or pressed to a maximized extent during the cutting operation by pressing beams 144 and the already mentioned pressing plates in the region between the transport clamp and the cutting edge. A blade 150*b* preferably moves in an oblique cut against a cutting strip, which is stationary per se.

The respective pressing beam 144 is thus directly operatively connected to the respective cutting blade 150*a*, 150*b*, 150*c* and ensures that that force, which is imperative for clean cut, is exerted on the printed product.

Basically, two main variants are predominant: on the one hand, as pos. 250 in FIG. 7 is intended to symbolize, a coupling in terms of force exists between the pressing beam and the cutting blade, i.e. the pressing beam force accordingly has a fixed value, the speed profile (pressing speed/acceleration) then generally also running monotonically.

Another variant, as pos. 251 in FIG. 7 is intended to symbolize, consists in decoupling the exertion of force of the cutting blade and pressing beam from one another, so that the pressing beam 144 then operates autonomously according to the following criteria:

The build-up of a specific force on the pressing beam takes place by means of the build-up of a corresponding torque at the servo motor by a servo drive. On the basis of a thickness measurement, the optimal pressing force is determined on the printed product, which can take place easily by means of stored control profiles. A single calibration is generally sufficient to detect a specific thickness variability of the printed products, if the pressing force characteristic taken as a basis can be regarded as constant because the differences of the book block thicknesses within a job are relatively small.

In contrast, it has to be considered, however, that a substantial reduction in the pressing speed and in particular the acceleration can be achieved by optimizing the pressing lift, particularly in the case of stiff and/or thin printed products. With this concept, however, it is advantageous that regardless of the production speed, the respective cutting device(s) always work at the maximum speed, which is not limited here by the cutting speed, but by the limits determined by the mechanics. It is also important that with a low machine speed, an increased cycle time is available, in particular for the transporting, aligning and pressing operations, as the same amount of time is always required for the cutting process.

The remaining two cutting locations are operated by the blades 150*a* and 150*c*, which substantially follow the same pressing and cutting philosophy. In the first cutting station 141, the head region of the book block is cut (see also FIG. 1). However, it is not ruled out for the first cutting operation to begin with the tail region of the book block, although in certain configurations this would necessitate an adaptation of the action location of the clamp, in all events the cutting device 140, and also of the width of the cuttings, proceeding from retaining the book spine side clamping $A^R$ (see FIG. 1).

Returning to FIGS. 1, 2, 3, during the cutting operation in the vertical direction (Y-plane, see FIG. 1) and in the horizontal direction (X-plane, see FIG. 1), a movable, opened first gripper 103 intervenes, the gripper being directed in the vertical direction against the book block spines. After the first cut, the first gripper 103 accepts the book block at the spine and the transport clamp 130 opens. Said transport clamp then travels into the acceptance position for the next book block. The first gripper 103 transports the book block from this first cutting operation (FIG. 1, pos. 1) vertically upwardly (Y-plane) and in the process travels by means of a superimposed, horizontal movement into the second cutting position (FIG. 1, pos. 2).

The movement section of the first gripper 103 in the vertical direction is controlled by the machine controller depending on the width of the cut book block, the movement section of the gripper also being able to be individually controlled in general in the horizontal direction with respect to the book block, as when a special gripping position is aimed for, for example, when the format and the portions to be cut off in the respective book block make necessary an asymmetric or virtually asymmetric or a one-sided clamping action caused by the center of gravity.

In the second cutting position (FIG. 1, pos. 2), the book block is positioned by a plurality of pressing strips, which belong to a battery of pressing strips (FIGS. 2, 3, pos. 200), with which the book blocks are clamped between the front side and the rear side. In FIG. 2, the pressing strip battery appears in the closed state, while the pressing strip battery is shown in the opened state in FIG. 3.

Figure 8:
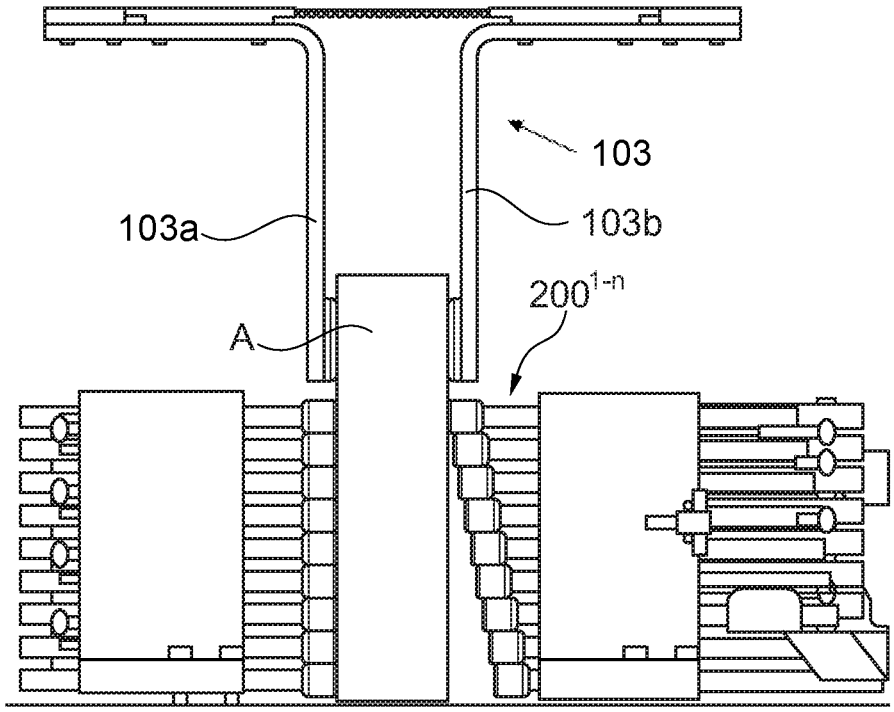
FIG. 8 is a snapshot during operation of the pressing strips.
Figure 9:
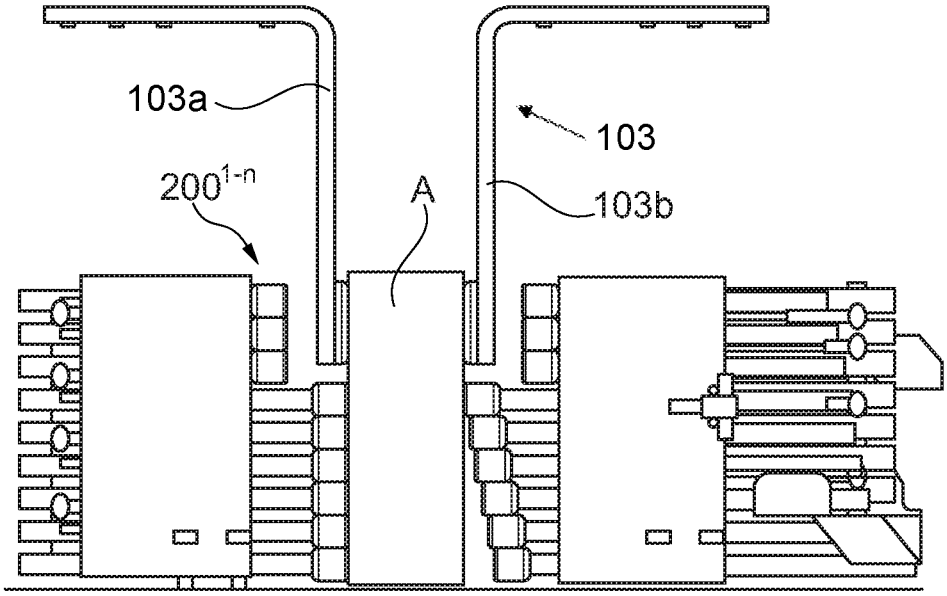
FIG. 9 is a further snapshot during operation of the pressing strips.

As can be seen in FIGS. 8 and 9, the individual pressing strips $\mathbf{200}^{1-n}$ close successively, beginning at the book spines, so that the air between the individual pages can be pressed out in a targeted manner in the direction of the cutting edge, a smoothing of the printed product as a body taking place at the same time. As then emerges well from FIG. 9, only as many pressing strips close as can find room between the position of the gripper 103 with the respective clamping jaws 103*a*, 103*b* and the second cutting station 142 at the second cutting location 2 (see FIG. 1). The same clamping jaws 104*a* and 104*b* belong to the other gripper 104 (see FIG. 1). Pressing over a large area of the book block is thus in turn achieved. In the second cutting station 142, the front side of the book block is now cut and this takes place in an analogous manner to in the first and the third cutting stations 141, 143 for the head or tail side.

Figure 10:
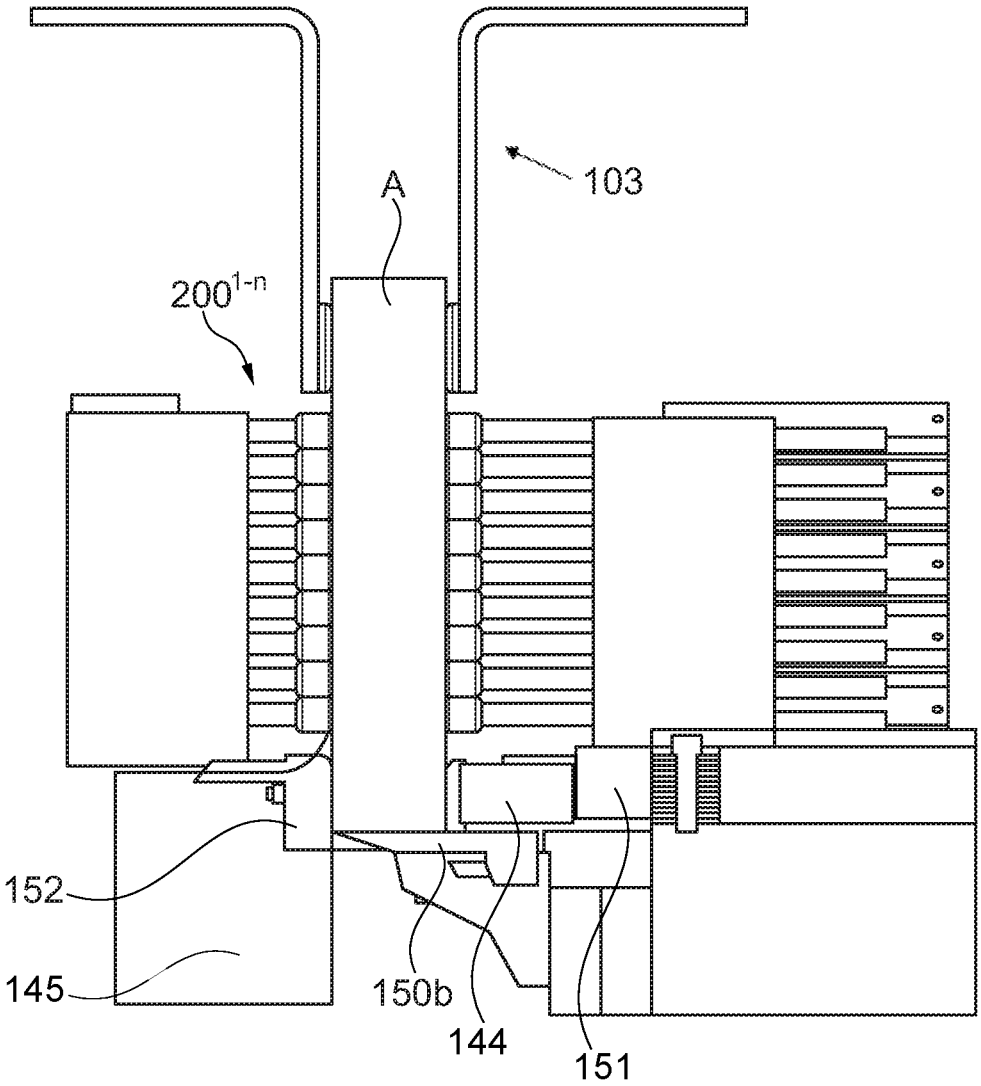
FIG. 10 is a further snapshot during the cutting operation.

Once the pressing strips $\mathbf{200}^{1-n}$ being used of the pressing strip battery 200 have clamped the relevant book block at the second cutting location 2 (see FIG. 1, pos. 2), as emerges from FIG. 10, the first gripper 103 can release the book block and be moved back into its acceptance position (cutting location 1, FIG. 1) for the next book block.

Furthermore, that ultimate force-related holding of the book block A during the cutting operation emerges from FIG. 10 in order to ensure that a high-quality cut can be carried out with the aid of the blade 150*b* shown. Therefore, when the pressing strips $\mathbf{200}^{1-n}$ being used (see FIGS. 8, 9) have accepted the book block A from the gripper 103, pressing beams (pos. 144) intervene and exert the definitive pressing force on the book block in the direct cutting region. In this case, this force has to be predominant with respect to the pressing force exerted by the pressing strips such that the cut carried out by the blade 150*b* allows the cutting edge to be sharply cut at a right angle. The pressing device consists of a rigidly positioned stop 152 as a component of a pressing plate 145 (see also FIG. 7) on the one side of the book block and of an opposing movable pressing beam 144 on the other side, which is pressed by a pressing bolt 151 against the book block.

In a further embodiment, the stop 152 can also be designed to be movable to take into account the thickness and/or the thickness consistency of the block book let in from above in each case, in other words so that the leading edges of the book block introduced cannot collide. This dynamic adaptation of the stop 152 can take place by means of the machine controller already mentioned.

The pressing bolt 151 for the pressing beam 144 may, for example, be driven by a motor, hydraulically or pneumatically and thus exert the pressing force that was established in advance on the book block.

The remaining pressing beams (see FIG. 7, pos. 144) also function according to the same principle at the remaining cutting locations 1, 3, which now produce the exertion of the pressing force in the vertical plane. It is also a question here of ensuring a right-angled, sharply cut book block edge.

As soon as the book block is cleanly pressed by the pressing strips $\mathbf{200}^{1-n}$, the second cutting operation (front cut) can then be carried out. Once the cutting operation has ended, a second gripper 104 (see FIG. 1) advances into the position above the pressing strip battery and grips the book block in an analogous manner as was the case with the first gripper 103. The position of the second gripper 104, in which it clamps the book block, depends here on the cut book block height. The controller brings the second gripper 104 into the previously calculated gripping position, so that the correct book block height is produced by the third cutting operation (see FIG. 1, pos. 3) at the book block.

Once the second cutting operation (front cut) has been carried out, the pressing strip battery 200 opens and the second gripper 104 moves the printed product on by a vertical movement (out of the cutting position), then a horizontal movement (feed to the next cutting position) and finally a vertical movement again into the cutting position for the third cut (tail portion) (see FIGS. 1, 2).

During the vertical movements in the region of at least one cutting position, the relevant loaded gripper, as required, completes another lateral offset movement with respect to a clamping face of the clamping device.

Figure 11:
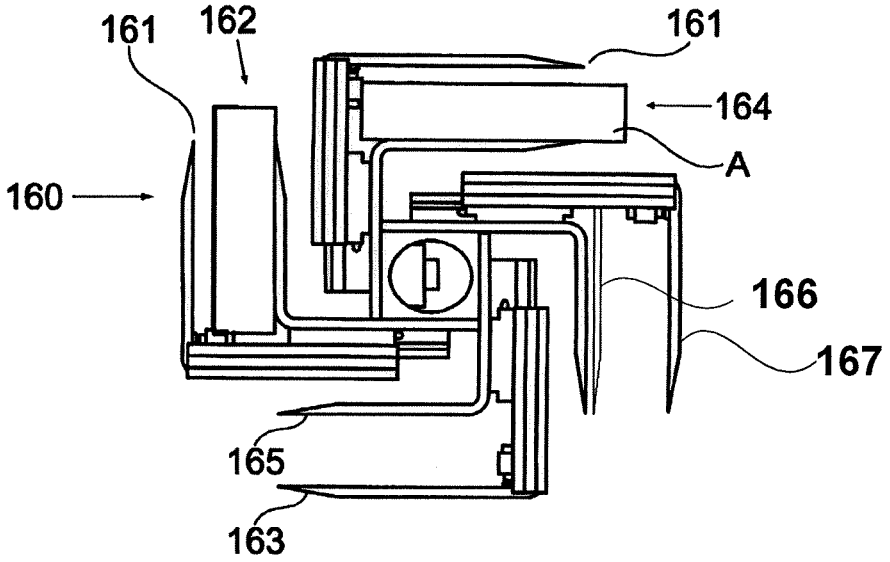
FIG. 11 shows a rotatable four-clamp system as a clamping device and transporting device.

Once the cutting operation has been carried out at the third cutting location 3 (see FIG. 1), the rotatable transporting device (four-clamp system) 160 according to FIG. 11, and therefore also the clamp 161 with the book block, move orthogonally with respect to the blade movement away from the blade. The rotatable four-clamp system 160 rotates through 90° during each clock cycle.

In this connection, the four-clamp system 160 that can be seen in FIG. 11 shows the position of the clamp 161 in the cutting position 162, in which a movable jaw 163 is still open. A further clamp acts within the transporting position 164. In this position, the book block A can be removed. The mode of functioning of the four-clamp system 160 ensures that the book block A, during the cutting process at the third cutting location 3 (see FIGS. 1, 7) and the rotary movement of the four-clamp system, is consistently pressed between the movable jaw 163 and the fixed jaw 165. Furthermore, two states of the clamp 161 are provided within a quadrant, namely a completely closed 166 position and a completely open 167 intermediary position are visible therein. One or other variant can be considered in a targeted manner within this quadrant, corresponding to the respective space conditions present at the rotation.

A conveyor belt, which is configured with movable rollers to convey the book block may be an example of a removal device. Other devices that have become known from the prior art may also be provided.

Figure 12:
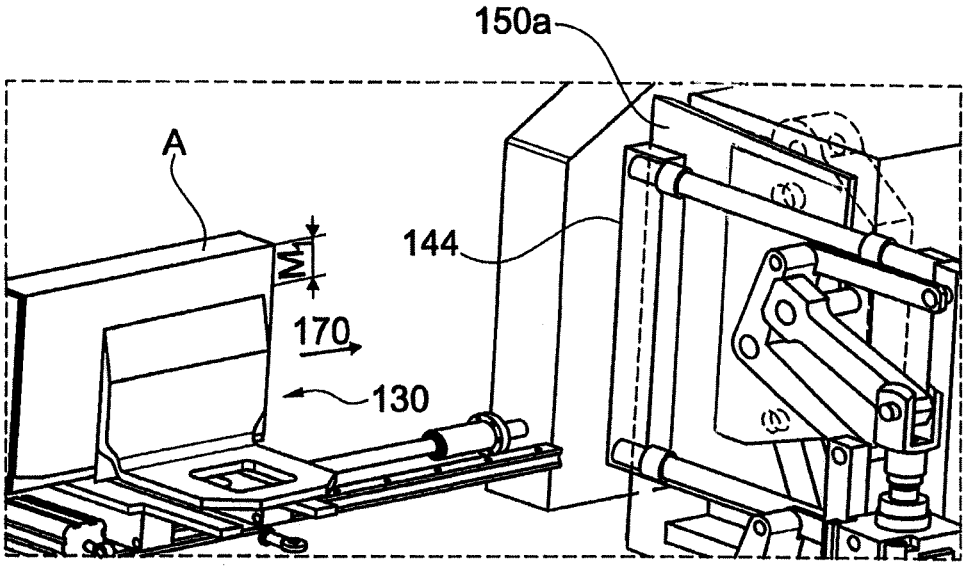
FIG. 12 shows the ultimate pressing of the book block during the cutting operation.

The ultimate pressing of the book block by pressing beams 144 during the cutting operation emerges from FIG. 12. A pressing of this type corresponds, with regard to the action, to that which was described for FIG. 10. The advancing device is characterized by pos. 170.

Figure 13:
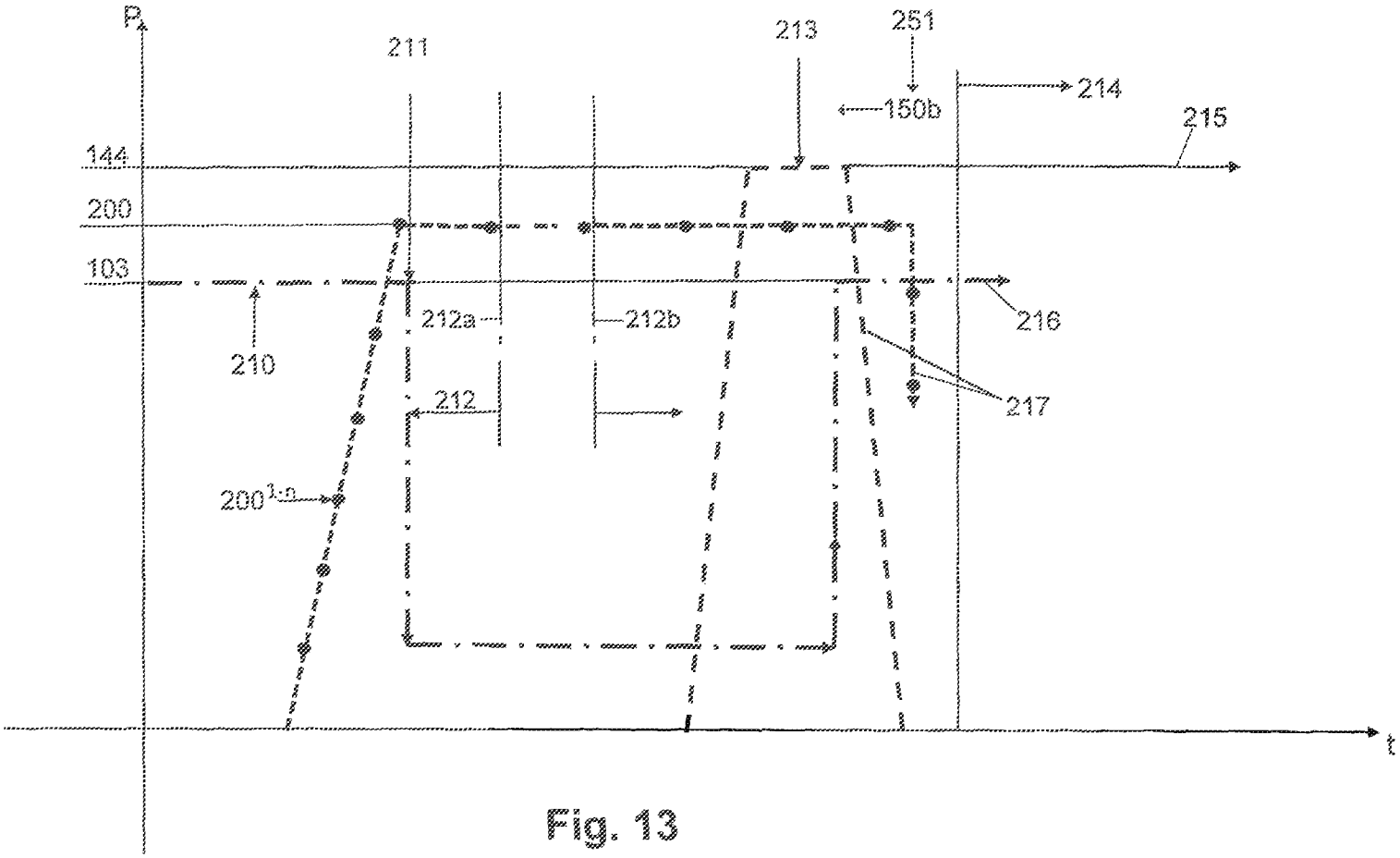
FIG. 13 shows the course of the development of force of various clamping elements during a cutting operation.

FIG. 13 shows the interdependence of the various pressing elements (clamping devices) on the printed product which, in relation to cutting location 2, is exerted by the various clamping devices 103, 200, 144, the one clamping device 200 consisting of a pressing strip battery 200 at this cutting location. The clamping forces of the various clamping devices in the graph may also only be understood qualitatively. The clamping force of the gripper 103, which is provided for the transport 210 of the printed product from one cutting location to the next, is smaller per se compared to the cutting location-related clamping forces of the assemblies 200 and 144, as this is a force which has to be sufficient only for the secure clamping action of the printed product during transport. At cutting location 2, the clamping force of the pressing strips $\mathbf{200}^{1-n}$ belonging to the pressing strip battery then rapidly builds up simultaneously or subsequently, so that the clamping force of the gripper 103 immediately reduces 211 (reduction point) as soon as the final clamping force of the pressing strips on the printed product has been reached. Within what framework the clamping force of the gripper on the printed product reduces is adjusted individually and also depends on the weight of the respective printed product. The important concluding clamping force on the printed product for the qualitative cutting quality is then exerted by the pressing beam 144 already mentioned, which adopts its position closely parallel to the plane of the cutting blade. As can be seen from the force graph according FIG. 13, the pressing beam 144 preferably develops the greatest clamping force, which takes place variably and in a phase-shifted manner 212 (intervention plane) with respect to the remaining clamping devices, as emerges from the parallel interrupt lines 212*a*, 212*b* (phase-shift interval). As soon as the pressing force exerted by the pressing beam 144 is present, the blade carries out the cutting operation 213. Thereafter, the pressing beam 144 still remains briefly in the cutting plane 215, until the clamping force of the gripper has built up to such an extent that a safe onward transport 214 of the printed product is ensured. Thereafter, the clamping forces of the remaining elements 144, 200 subsequently reduce according to a specific reduction curve 217, so that the onward transport plane 216 with the printed product gripped to the full by the gripper 103 is open again. This dynamic basically also applies to the gripper 104 belonging to the second support 102 (see FIG. 1) in operative connection with the respective clamping devices.

In addition, FIG. 13 symbolically shows that the mutually matched, uniform, non-uniform or adaptive speed and/or movement profile of the two clamping elements of a clamping device can also be provided for a one-sided exertion of pressing force of the pressing beam 144, in that the force provision for the blade 150*b* is no longer coupled to that for the pressing beam 144, but the latter autonomously exerts its pressing force on the printed product, as position 251 is intended to symbolize (see also FIG. 7). The exertion of pressing force of the pressing beam on the printed product can then be provided according to specific criteria. The speed profile of the pressing beam 144 can be transferred into a different mode directly after the first contact with the printed product. This also applies to the development of force on the printed product, which can take place, depending on the input, successively monotonically, in an increasing or reducing manner. Thus if a certain flexion is required during the development of force of the pressing beam 144 toward the conclusion of the pressing in order, for example, to protect the slightly thickened spine portion of the printed products against the formation of wrinkles, this can be provided by the activation of a corresponding control profile, according to which, for example, the monotonically increasing development of force can pass into a curve according to the principle of a capacitor charge. Accordingly, it is then readily possible to provide an exponential development of force, which is used in an intermediary or overarching manner.

In addition, EP 1 647 373 A1 is to be an integrating component of this description, in particular when it is a question of showing how it is intended to coordinate the drives for the pressing force supply and the blade dynamics.

Figure 14:
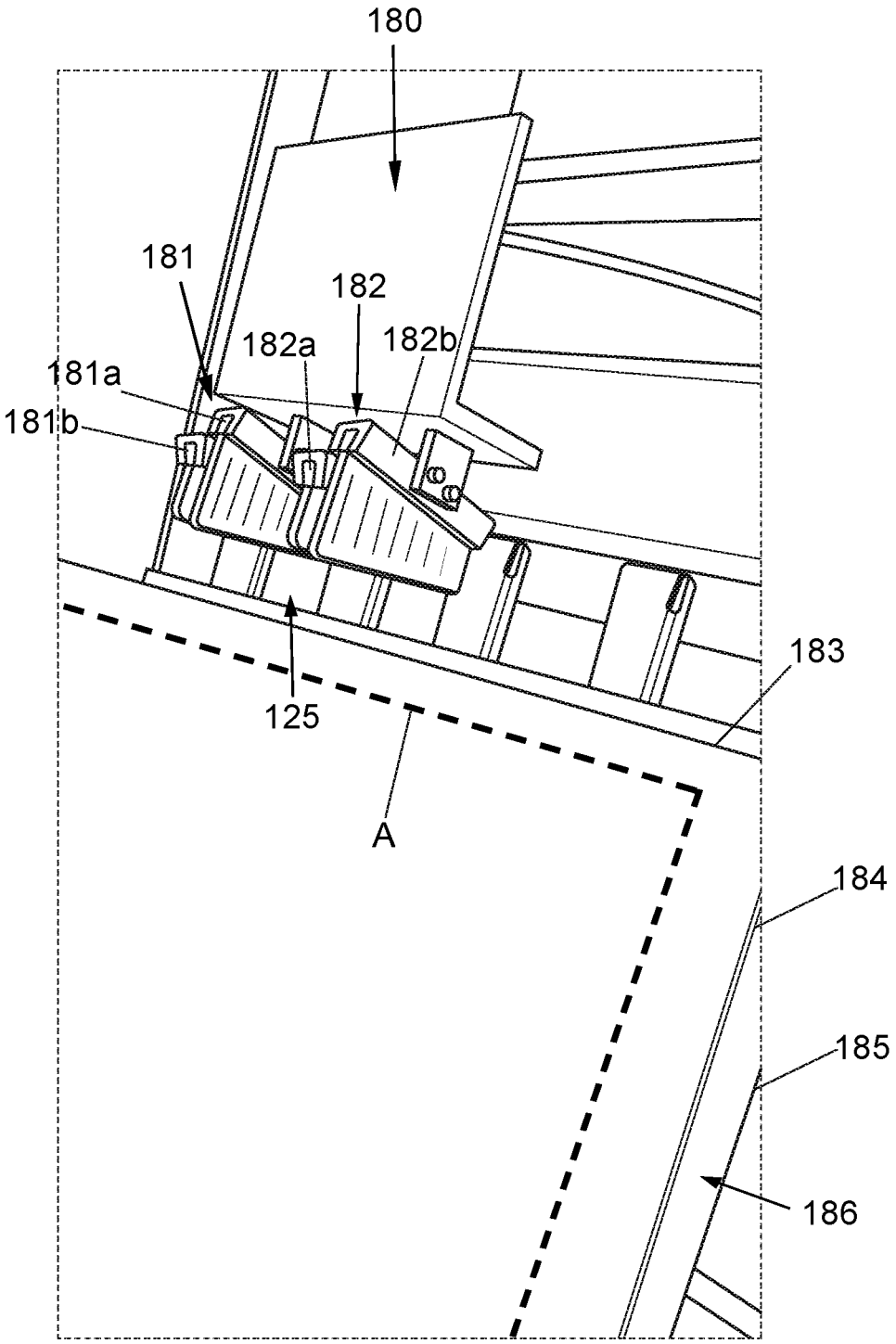
FIG. 14 shows an aligning device for the vertical exertion of pressure on the printed product.

FIG. 14 shows the configuration of an aligning device 125 (see also FIG. 3). This consists of a receiving plate 180 acting from above, which carries brush bodies 181, 182 on the printed product side, which exert a pressure on the front wrapper ends 183 projecting over the printed product A) such that the spine of the printed product coincides with the support face within the insertion wheel 120. As the wrapper ends 184 lie in the same alignment plane at the front, they can be seen better at positions 185 and 186 (at the head or tail side of the printed product A). The two brush bodies 181 and 182 consist in each case of two sub-brush bodies 181*a*, 181*b*; 182*a*, 182*b*, which are at an angle to one another in such a way that the respective wrapper end is gripped in a wedge shape and can be pressed downwardly correspondingly in parallel, whereby the wrapper ends do not undergo any damaging bulging.

Figure 15:
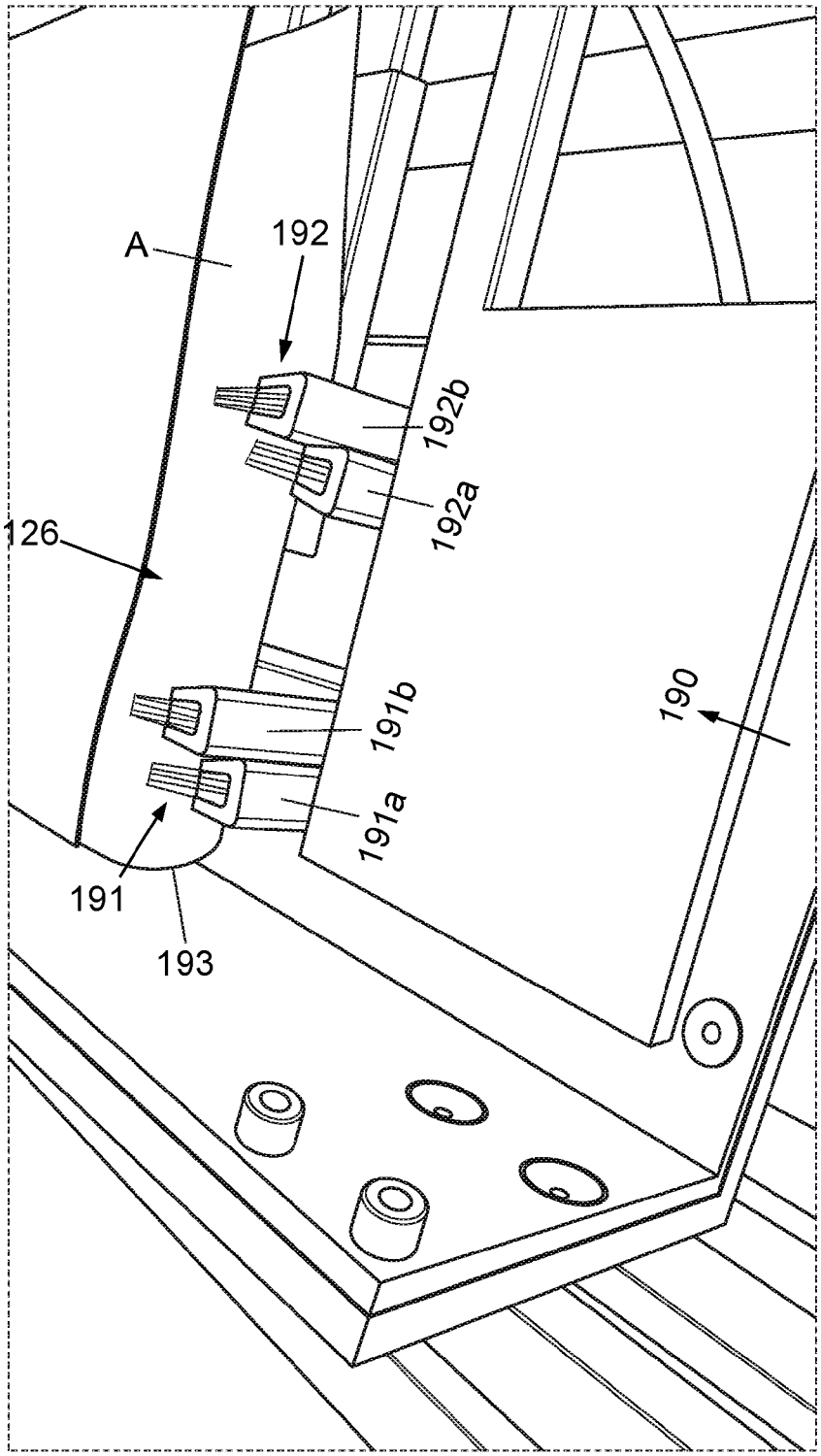
FIG. 15 shows an aligning device for the horizontal exertion of pressure on the printed product.

FIG. 15 shows the configuration of a further aligning device 126 (see also FIG. 3). This consists of a receiving plate 190, which acts from the side (head or tail side) and carries brush bodies 191, 192 on the printed product side, which exert a pressure on the head-side or tail-side wrapper ends 184, 185 protruding beyond the printed product A, such that the printed product A is positioned accordingly for the cutting operations. The overhanging wrapper ends can be seen here in relation to the spine portion 193 of the printed product A. The two brush bodies 191 and 192 consist in each case of two sub-brush bodies 191*a*, 191*b*; 192*a*, 192*b*, which are at an angle to one another in such a way that the respective wrapper end can be gripped in a wedge shape by the brush bodies and the entire printed product body can be positioned laterally as specified, whereby the wrapper ends do not undergo any damaging bulging.

Figure 16:
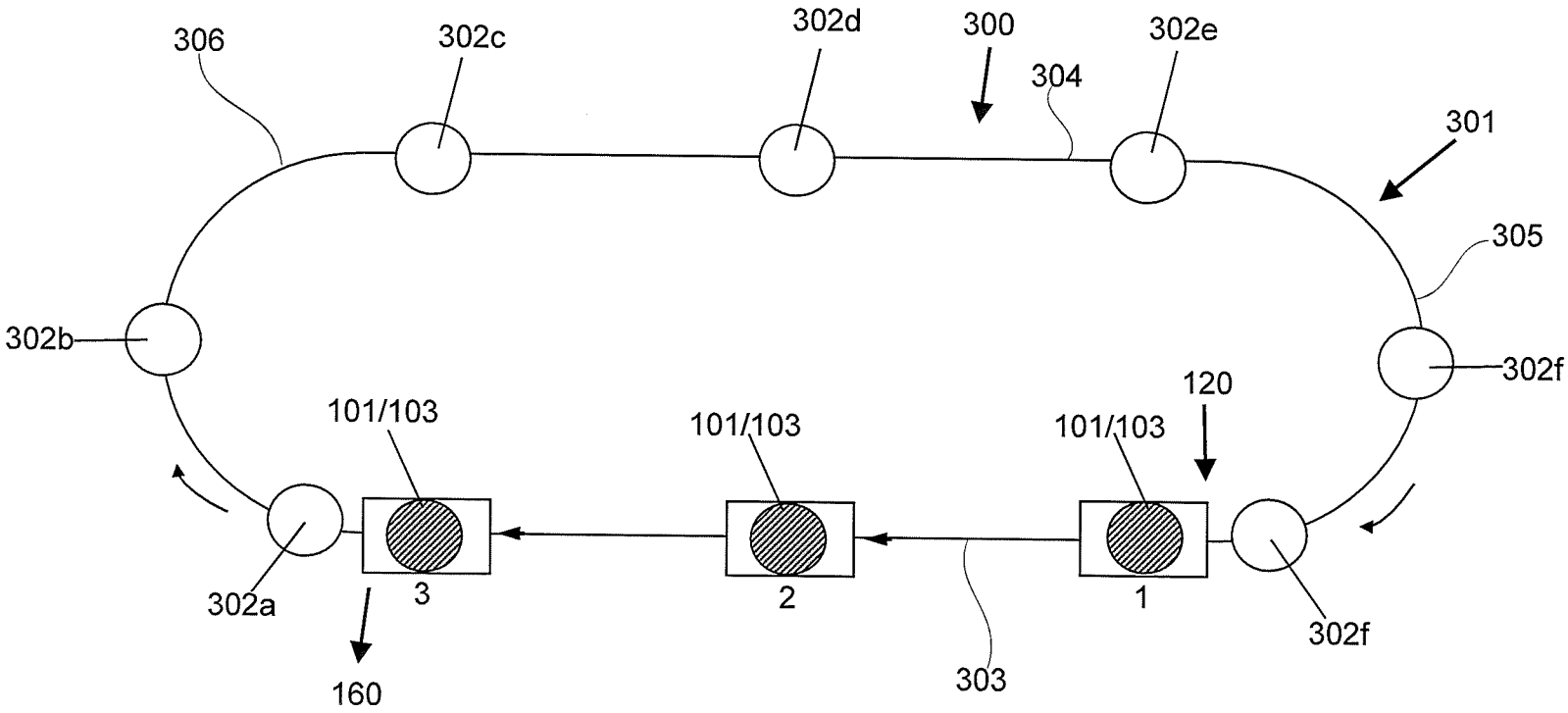
FIG. 16 shows a further transporting device for the printed products.

FIG. 16 shows a further transporting device 300 of the printed products from one cutting location 1 to the next 2 and from the latter to a third 3. The cutting operations carried out at these cutting locations are the same as described for FIG. 1.

The important difference compared to the dynamics according to FIG. 1 consists here in that at least three supports having respective grippers 101/103 are operatively in use along a substantially ellipse-like section 301, this functional peripheral section consisting of a front path 303 and a rear path 304 running substantially in parallel, the two paths passing into one another by a lateral curvature 305, 306 in each case. The front path is used to guide the supports 101 following one another in the clock cycle in a straight line, or virtually in a straight line, along the cutting locations 1, 2, 3. The number of supports 101 along the section depends on the maximum permitted clock cycle, i.e. each support is responsible for accepting a printed product, and guides this over the basic three cutting locations 1, 2, 3 without carrying out a transfer to another support. The clock cycle is configured, in a production-maximizing manner, in such a way that the supports closely follow one another and the distance from one another depends on the time required for the individual cutting operations, as a result of which generally more than three supports are used. A reduction of the number of supports can be achieved for example, when they undergo acceleration along the rear path 304 between the last cutting location 3 and the first cutting location 1.

Thus with an arrangement of this type, the intermediary cutting location-specific deliveries and acceptances of the printed product can thus be circumvented by supports travelling back and forth (see FIG. 1). On the other hand, in order to keep production high, more rotating supports 302*a* to 302*f* generally have to be provided as the supports need time to travel over the rear path 304.

For better understanding, the supports that are in operative use are drawn hatched, while the other unloaded ones, in other words on the downstream side of the transporting device 160, which are in each case on the way to the advancing device 120 for the renewed acceptance of a printed product, are shown unhatched.

A transport variant of this type characterized by an ellipse-like section 301 is a good basis for centralized cutting of the printed products when, in other words, the three cutting operations are carried out at a single cutting location, i.e. when the acceptance of the printed product, its feed to the central cutting location, and its subsequent delivery take place by means of one and the same support. Accordingly, a centralized cutting of this type would advantageously be arranged within the second cutting location 2. The supports in use should then advantageously not travel back over the front path 303 into the advancing device 120, but over the rear path 304 so as not to impede the production flow.

It is obvious that with a central cutting location to cut all the formatting edges of the printed product, provisions must be made for the movement of the side blades and the associated pressing beams to be phase-shifted with respect to the movement of the front blade and the associated pressing beam, so that a collision of the blades against one another can be prevented.

The described three-knife trimmer 100 according to the invention has the following advantages compared to known three-knife trimmers:

During cutting, the book block is pressed almost over the whole area by clamps or pressing strip batteries. Only in one region of the book spine does the book block have a free face $M_1$. This is not critical because the bound book block is sufficiently compact in this region, and the pressing strips support the book block within the respective cutting station of the cutting devices in the cutting region. Pressing the book block over the whole area leads to a high cut quality.

Pressing over the whole area is achieved in a simple manner. No webs, support elements or support strips have to be adjusted depending on the format. As a result, a high clock cycle number and therefore a high output of the three-knife trimmer can be achieved.

As, with the three-knife trimmer according to the invention, the book block is transported in a suspended manner to the individual cutting stations 141, 142, 143 (see FIG. 7), no support of the pages of the book block is necessary at the transfer points in the transport system. As the book blocks are not transported horizontally, the book pages do not sag between the support points when the support faces are not over the whole area, as a result of which they cannot catch at the transfer points.

The three cutting stations 141, 142, 143 of the cutting device are U-shaped with the open sides of the U arranged downwardly. The portion of book block to be cut off in all three cutting operations takes place in operative connection with the pressing beams 144 (see FIG. 7, and in particular FIG. 10) toward the interior of the U-shape. As a result, it is possible with a single disposal device arranged at the lower side to successfully "transport out" all the three cut-off portions. These portions drop down namely by gravity without further aids.

Good disposal of cuttings, regardless of whether these are from book blocks or brochures, is of great significance because during the industrial production of individual books, the different formats are very often firstly completed at the three-knife trimmer. In this case, the book blocks are fed to the three-knife trimmer in a size matched to the largest end format, which, in the case of greatly reduced end formats, leads to large cut portions.

It is conventional in three-knife trimmers having cutting cassettes and pressing punches to align the book block by two right-angled stops in the corners formed by the book spine and the head side and the book spine and the tail side, and a stop from the book block front side. When producing books, brochures, etc. having variable formats, wrappers of the same format are generally used for a specific format range. If the thickness of the book block now varies and if the books are bound by binding machines which have fixed edge processing, the wrapper at the uppermost side of the book does not project to an equal extent to that at the last side of the book.

If the height of the book block varies, the wrapper accordingly projects more or less with respect to the book. The book blocks are generally produced with a fixed overhang of the wrapper on the one side and a variable overhang on the other side.

In the case of products of this type, the alignment of the book block as in three-knife trimmers having cutting cassettes and pressing punches is unsuitable.

In the three-knife trimmer according to the invention, the uncut book block or the uncut brochures are aligned at the tail or head edge and the processed spine edge. Thus, the variable overhangs of the wrapper at the book block height and book width are not an issue.

For each book block to be cut or for each brochure to be cut, the controller of the three-knife trimmer has to know the product data from which the necessary movements of the transport members can be calculated, such that a cut book having the desired format dimensions is ultimately produced.

These data can be transmitted to the controller in a variety of ways. Some possibilities are listed below by way of example. Each book block or each brochure is equipped with an identification feature. A feature reader at the entry to the three-knife trimmer reads the identification feature (for example: one-dimensional or two-dimensional barcode, RFID chip, sign, picture, etc.) and transmits the information from the feature with the machine clock cycle allocation to the controller. The feature may contain the necessary information which maps the cut printed product dimensions, or the information which is lacking can be supplemented from a database.

In another system, the book blocks are fed in clocked manner to the three-knife trimmer. With each clock cycle, the information necessary to cut the book block to the correct dimensions is also supplied to the controller of the three-knife trimmer. Data delivered with the book block can also be supplemented here by data from a database.

A further possibility consists in that the data are made known to the three-knife trimmer with a book block order before the book blocks are fed in. With each book block that is fed in, the three-knife cutter processes the next dataset in the predetermined order. The feeding of the book blocks has to be made in the correct order here. A feature reader, which controls the order, can additionally be used for control While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A device for carrying out cutting operations on at least one unbound formatting edge of at least one printed product, the device comprising:

at least one cutter configured to carry out each of a plurality of edge-related cutting operations; and at least one transporter operatively connected to a printed product-related advancing device for a first one of the cutting operations and to a printed product-related transporting device, which is operative after a last one of the cutting operations, whereby the printed product is transportable from a first cutting location, at which the first cutting operation for a first formatting edge of the printed product takes place, to a second cutting location, at which a second one of the cutting operations for a second formatting edge takes place, and to a third cutting location, at which a third one of the cutting operations for a third formatting edge is carried out, after the second cutting operation at the second cutting location has been carried out, wherein the at least one transporter includes a guide section such that the transport of the printed product from one cutting location to the next is carried out along the guide section, and wherein the at least one transporter includes a gripper with which the printed product is gripped by the spine and conveyable from one cutting location to the next in a suspended manner.

2. The device according to claim 1, wherein the printed product to be cut comprises a connected book block, individual brochures or a number of stacked brochures.

3. The device according to claim 1, wherein the printed products, before and/or after the cutting operations, have the same or variable format dimensions with the same or different thickness dimensions.

4. The device according to claim 1, wherein:

the first edge to be cut at the first cutting location relates to a head portion, the second edge to be cut at the second cutting location relates to a front portion, and the third edge to be cut at the third cutting location relates to a tail portion of the printed product, or wherein the first edge to be cut at the first cutting location relates to the tail portion, the second edge to be cut at the second cutting location relates to the front portion, and the third edge to be cut at the third cutting location relates to the head portion of the printed product.

5. The device according to claim 1, wherein the advancing device for alignment in terms of location of a printed product configured as a book block has the shape of a multi-part insertion wheel, which is operable according to the following criteria:

a) during a first 90° rotation of the insertion wheel, a rake-like guide, which is folded with respect to the book block, carries out a pivotable movement in such a way that the book block lies on its spine after the 90° rotation, whereupon the book block is secured against fanning out and/or falling over;

b) the rake-like guide is coupled to a clamping assembly, by which the book block lying on its spine is momentarily clamped, wherein the clamping assembly is kinematically operable in such a way that the rake-like guide is transportable into a book block thickness-dependent position;

c) thereafter, the clamping assembly opens again so that the spine of the book block, following gravity, is aligned with a stop face within the insertion wheel;

d) thereafter, the clamping assembly closes again, whereupon the book block has a defined position;

e) the insertion wheel then rotates by two clock cycles through 90° in each case per clock cycle, whereby the book block is transportable into a position, which is now suspended, with respect to the cutting locations;

f) during the rotary movement in e), the first rake-like guide and a second guide, which is operatively connected thereto, are pivoted away from the book block, the book block being held in a region at least of one part of its spine by the clamping assembly, wherein the portion of the book block released by the guides is suspended vertically downward solely due to gravity.

6. The device according to claim 5, wherein, in an open state of the clamping assembly, additional means are present, which are drivable from above and/or from the side, by which a brief pressing force is exertable directly or indirectly on the book blocks, and by the pressing force, a securing of the end position of the book blocks is achieved with respect to the stop face or another predetermined position at least in the horizontal direction.

7. The device according to claim 1, wherein the advancing device for a printed product comprising at least one brochure, has the shape of a multi-part insertion wheel, which is operable according to the following criteria:

a) during a first 90° rotation of the insertion wheel, a rake-like guide, which is foldable with respect to the brochure, carries out a pivotable movement in such a way that the brochure lies on its spine after the 90° rotation, whereupon the brochure is secured against fanning out and/or falling over;

b) the rake-like guide is coupled to a clamping assembly, by which the brochure is momentarily clamped in a position lying on its spine, whereupon this clamping assembly is kinematically operable in such a way that the rake-like guide is transportable into a book block thickness-dependent position;

c) thereafter, the clamping assembly opens again so that the spine of the brochure, following gravity, is aligned with a stop face within the insertion wheel;

d) thereafter, the clamping assembly closes again, whereupon the brochure has a defined position;

e) the insertion wheel thereupon continues to rotate by two clock cycles through 90° in each case per clock cycle, whereby the brochure is transportable into a position, which is now suspended, with respect to the cutting locations;

f) during the rotary movement in e), the first rake-like guide and a second guide, which is operatively connected thereto, is pivotable away from the brochure, wherein the brochure is held in a region of at least one part of its spine by the clamping assembly, wherein the portion of the brochure released by the guides is suspended vertically downward solely due to gravity.

8. The device according to claim 1, wherein the advancing device is operatively connected in a region of the first cutting location to a movable clamping device, which is equipped with clamping plates and accepts the printed product from the advancing device, whereupon the printed product is fed to the first cutting operation.

9. The device according to claim 1, wherein the transporter comprises at least of a support having at least one printed product-related gripper, wherein the gripper is configured to grip the printed product to be cut on a spine side of the printed product, and wherein the following controller-assisted translatory movements along a guide section are taken as a basis for the gripper with respect to the cutting locations:

a) accepting the printed product by use of the gripper belonging to the support after completion of the first cutting operation at the first cutting location;

b) transporting the printed product by the same support/gripper to the second cutting location and, after the cutting operation has taken place at the second cutting location, c) transporting the same printed product by the same support/gripper to the third cutting location to carry out the third cutting operation, and thereafter, d) initiating return of the same support/gripper into the starting position at the first cutting location for a renewed acceptance of a subsequent printed product, once the first cutting operation has been carried out thereon at the first cutting location.

10. The device according to claim 1, wherein the transporter substantially consists of two printed product-related supports, each having a gripper, wherein the grippers are configured to grip a spine side of the printed product to be cut, wherein the two supports/grippers are operatively connected to one another, and wherein the supports/grippers are operable with respect to the cutting locations by the following controller-assisted translatory movements along a guide section:

a) the first gripper of the first support accepts the printed product once the first cutting operation has taken place at the first cutting location;

b) the first support then travels with the printed product to the second cutting location, positions the printed product there to carry out the second cutting operation and then travels back empty to the first cutting location, at which renewed acceptance of a subsequent printed product, which is present already cut at the first cutting location, takes place;

c) in the meantime, the second support/gripper accepts the printed product directly after the first cutting operation has ended at the second cutting location and transports the printed product to the third cutting location, at which the third cutting operation takes place;

d) thereafter, the second support/gripper returns empty to the second cutting location, at which a subsequent printed product is again present already cut, whereupon the second support/gripper again travels with the subsequent printed product to the third cutting location, at which the third cutting operation takes place.

11. The device according to claim 1, wherein the transporter comprises of two, three supports, which are guided along a closed guide section, wherein each of the supports in a region of the cutting locations is in each case individually loaded with at least one printed product for the respective cutting operation, wherein each of the supports, after leaving the third cutting location, is returnable unloaded over the remaining course of the closed guide section to the first cutting location such that, before or after the first cutting operation, a subsequent printed product is accepted, and wherein the support with the accepted printed product is successively guidable according to a specific clock cycle to the remaining cutting locations to carry out the pending cutting operations.

12. The device according to claim 11, wherein the closed guide section substantially has the shape of an ellipse, virtual ellipse, or the shape of a round or virtually round course.

13. The device according to claim 11, wherein the number of supports rotating along the guide section depends on the clock cycle of the cutting operations and/or depends on the selected return speed of the supports between the third and the first cutting location.

14. The device according to claim 1, wherein all the cutting operations take place at a central cutting location, and wherein movements of side blades and of associated pressing elements take place in a phase-shifted manner with respect to movement of front blades and associated pressing elements so as to prevent a collision.

15. The device according to claim 1, wherein the gripper is equipped at an end with clamping jaws configured to act on the printed product, wherein at least one targeted lateral offset movement is enabled to be carried out with respect to a pressing face of at least one locally arranged clamping and/or pressing device by the gripper loaded with the printed product in a region of at least one of the cutting locations before and/or after the cutting operation.

16. The device according to claim 1, wherein the respective printed product is grippable by the clamping jaws of the respective gripper symmetrically, virtually symmetrically, asymmetrically or in a manner maximized with respect to its center of gravity and/or depending on the portion lengths of the edges to be cut off.

17. The device according to claim 1, wherein the gripper is configured to carry out a further positioning movement in at least one plane with respect to a stationary pressing face of a clamping device in at least one cutting location before and/or after the respective cutting operation.

18. The device according to claim 1, wherein the transporting device is operative at the third cutting location, and is operable according to the following criteria:

a) the transporting device is operable by a wheel operating in multiple parts;
b) the transporting device has a clamping device, which comprises least a first jaw and at least a second jaw, with which jaws a clamping action is exertable on the printed product during the cutting process;
c) after the cutting operation, the multi-part wheel carries out a partial rotation, by which the printed product is transportable into an unloading position.

19. The device according to claim 1, wherein one cutting device at each cutting location is operatively connected to a stationary or virtually stationary clamping and/or pressing device in each case, with which at least one pressing force is exertable on the printed product to be cut, wherein the clamping device has singly-acting or multiply-acting controllable pressing faces belonging to at least one clamping jaw, wherein the clamping device is matched to a format size of the printed product, or, during the course of operation, is adjustable by simultaneous adaptations to the respective format sizes of the printed product.

20. The device according to claim 19, wherein the pressing force, which is producible on a pressing beam belonging to the pressing device to press the printed product in conformity with the cut is directly, or virtually directly, operatively connected to a drive, which is also causally configured to introduce a knife cutting force within the cutting locations.

21. The device according to claim 19, wherein the pressing force, which is producible on a pressing beam belonging to the pressing device to press the printed product in conformity with the cut is produced by an autonomous drive, which is detached from the drive to produce a cutting force of a cutting blade within the cutting locations.

22. The device according to claim 19, wherein the exertion of force of a cutting blade and of a pressing beam belonging to the pressing device are decoupled from one another in such a way that the pressing force of the pressing beam acting on the printed product is adjustable as follows: starting from a thickness measurement and composition of the printed product, an optimal pressing force on the printed product to be processed is determined continuously, or is retrieved via stored control profiles.

23. The device according to claim 19, wherein a pressing force in conformity with the cut is exertable on the printed product by the pressing device configured as a pressing beam, at least during an operative phase.

24. The device according to claim 19, wherein the clamping jaws are equipped with at least one clamping device, which is movable with respect to one another according to the following criteria:

a) each clamping jaw is directly or indirectly operatively connected to a drive operating for frictional clamping action, wherein the clamping jaws guided by the drives have an adjustable and/or predictively controlled lifting and frictional connection profile, which are aligned with any shape design of the printed product that is present;
b) the frictional movement profile carried out by the clamping jaws is configured such that the printed product is grippable symmetrically or virtually symmetrically with respect to a thickness-related center line of the printed product;
c) a clamping force is exertable by the clamping jaws, at least during the operative phase, on the printed product by a mutually matched uniform, non-uniform or adaptive speed and/or movement profile.

25. The device according to claim 1, wherein clamping and/or pressing devices, which are operatively connected to one another and exert force, are provided at each of the cutting locations, wherein a clamping force of the gripper intended to transport the printed product from one cutting location to the next is smaller compared to first force-exerting clamping devices, and wherein a clamping force is exertable on the printed product by the first force-exerting clamping devices, the clamping force being smaller than a second cutting location-related clamping device.

26. The device according to claim 25, wherein the second cutting location-related clamping device has the shape of a pressing beam, which is configured to press directly against the printed product, or is matched specifically in terms of the pressing force by a mechanical, pneumatic, hydraulic counter-force development.

27. The device according to claim 1, wherein at each of the cutting locations before, during and after the cutting operation, the following pressing forces are operative on the printed product:

a) a pressing force on the printed product exertable by clamping jaws, which belong to the gripper, the pressing force being configured to transport the printed product from one cutting location to the next;
b) a further pressing force on the printed product exertable by a first clamping device acting at each of the cutting locations, the further pressing force being operative stationarily on the printed product in a region of the respective cutting location;
c) a second further pressing force on the printed product exertable by a second clamping device configured for pressing and acting at each of the cutting locations, the second further pressing force being directly operative in the region of the respective cutting location.

28. The device according to claim 27, wherein a first clamping device is operative at the first cutting location, wherein a further first clamping device is operative at the second cutting location, wherein a further first clamping device is operative at the third cutting location, and wherein additionally a second clamping device is operative, in each case, at each of the cutting locations.

29. The device according to claim 28, wherein a first clamping device, which is operable at least at the second cutting location, comprises individual pressing strips arranged vertically or virtually vertically downstream, wherein the pressing strips are rigidly positioned on one side of the printed product, while the pressing strips are configured to carry out a frictional pressing movement on the other side of the printed product.

30. The device according to claim 28, wherein a first clamping device, which is operable at least at the second cutting location comprises individual pressing strips arranged vertically or virtually vertically downstream, and wherein the pressing strips are configured to carry out uniform, or virtually uniform, frictional pressing movements directed at the printed product on the two sides of the printed product directly or indirectly.

31. The device according to claim 28, wherein a first clamping device, which is operable at least at the second cutting location comprises individual pressing strips arranged vertically or virtually vertically downstream, wherein frictional pressing movements are exertable by the pressing strips arranged on both sides of the printed product, the movements of which are configured for symmetry or virtual symmetry with respect to a center line of the printed product in terms of thickness.

32. The device according to claim 28, wherein upon a subsequent pressing movement of the pressing strips on the printed product, a pressing action thereof begins with a first one of the pressing strips in a region of the spine of the printed product so as to then carry on by the use of the remaining pressing strips continuously approximately into the plane of the edge to be cut.

33. The device according to claim 32, wherein the subsequent activation of the pressing strips starting from the spine of the printed product through to the edge to be cut has the effect that the air caught between signatures of the printed products can be continually pressed out.

34. The device according to claim 1, wherein the cutting operation with respect to the individual formatting edges of the printed product can be carried out by an individually operating cutting operation at the respective cutting location.

35. The device according to claim 34, wherein at least one cutting operation is operable by a singly-acting cutting blade of the cutter.

* * * * *